US010311884B2

(12) United States Patent
Klejsa et al.

(10) Patent No.: US 10,311,884 B2
(45) **Date of Patent: *Jun. 4, 2019**

(54) ADVANCED QUANTIZER

(71) Applicant: DOLBY INTERNATIONAL AB, Amsterdam (NL)

(72) Inventors: Janusz Klejsa, Bromma (SE); Lars Villemoes, Jarfalla (SE); Per Hedelin, Gothenburg (SE)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/933,108

(22) Filed: Mar. 22, 2018

(65) Prior Publication Data

US 2018/0211677 A1 Jul. 26, 2018

Related U.S. Application Data

(63) Continuation of application No. 14/781,700, filed as application No. PCT/EP2014/056855 on Apr. 4, 2014, now Pat. No. 9,940,942.

(Continued)

(51) Int. Cl.
*G10L 19/04* (2013.01)
*G10L 19/035* (2013.01)

(Continued)

(52) U.S. Cl.
CPC ..... *G10L 19/035* (2013.01); *G10L 19/005* (2013.01); *G10L 19/028* (2013.01); *G10L 19/20* (2013.01)

(58) Field of Classification Search
USPC ..... 704/222, 226, 230, 500–504
See application file for complete search history.

(56) References Cited

U.S. PATENT DOCUMENTS 5,388,181 A 2/1995 Anderson
5,414,796 A 5/1995 Jacobs (Continued)

FOREIGN PATENT DOCUMENTS

EP 2077550 7/2009
EP 2381580 10/2011

(Continued)

OTHER PUBLICATIONS

Derpich, Milan S. "A Bound on the MSE of Oversampled Dithered Quantization with Feedback" IEEE Signal Processing Letters, vol. 16, No. 6, Jun. 2009, pp. 541-544.

(Continued)

*Primary Examiner* — Leonard Saint Cyr

(57) ABSTRACT

The present document relates an audio encoding and decoding system (referred to as an audio codec system). In particular, the present document relates to a transform-based audio codec system which is particularly well suited for voice encoding/decoding. A quantization unit configured to quantize a first coefficient of a block of coefficients is described. The block of coefficients comprises a plurality of coefficients for a plurality of corresponding frequency bins. The quantization unit is configured to provide a set of quantizers. The set of quantizers comprises a plurality of different quantizers associated with a plurality of different signal-to-noise ratios, referred to as SNR, respectively. The plurality of different quantizers includes a noise-filling quantizer; one or more dithered quantizers; and one or more un-dithered quantizers. The quantization unit is further configured to determine an SNR indication indicative of a SNR attributed to the first coefficient, and to select a first quantizer from the set of quantizers, based on the SNR indication. In addition, the quantization unit is configured to quantize the first coefficient using the first quantizer.

8 Claims, 11 Drawing Sheets

Related U.S. Application Data

(60) Provisional application No. 61/808,673, filed on Apr. 5, 2013, provisional application No. 61/875,817, filed on Sep. 10, 2013.

(51) Int. Cl.

| | |
|---|---|
| ***G10L 19/005*** | (2013.01) |
| ***G10L 19/028*** | (2013.01) |
| *G10L 19/20* | (2013.01) |

(56) References Cited

U.S. PATENT DOCUMENTS

| | | | | |
|---|---|---|---|---|
| 5,805,228 | A | 9/1998 | Proctor | |
| 5,956,674 | A | 9/1999 | Smyth | |
| 5,990,815 | A | 11/1999 | Linder | |
| 6,029,126 | A | 2/2000 | Malvar | |
| 6,170,052 | B1 | 1/2001 | Morrison | |
| 6,253,165 | B1 | 6/2001 | Malvar | |
| 6,784,812 | B2 | 8/2004 | Craven | |
| 7,106,228 | B2 | 9/2006 | Bessette | |
| 7,447,631 | B2 | 11/2008 | Truman | |
| 7,885,809 | B2 | 2/2011 | Ramprashad | |
| 8,494,863 | B2 | 7/2013 | Biswas | |
| 8,924,201 | B2 | 12/2014 | Hedelin | |
| 9,503,120 | B1 | 11/2016 | Tan | |
| 2006/0125668 | A1 | 6/2006 | Miller | |
| 2006/0147124 | A1* | 7/2006 | Edler | G10L 19/02 382/260 |
| 2007/0016404 | A1 | 1/2007 | Kim | |
| 2007/0016417 | A1* | 1/2007 | Sung | G10L 19/035 704/230 |
| 2007/0223582 | A1 | 9/2007 | Borer | |
| 2010/0245136 | A1 | 9/2010 | Azadet | |
| 2010/0245138 | A1 | 9/2010 | Azadet | |
| 2010/0286990 | A1* | 11/2010 | Biswas | G10L 19/035 704/500 |
| 2010/0286991 | A1* | 11/2010 | Hedelin | G10L 19/035 704/500 |
| 2011/0194600 | A1 | 8/2011 | Demos | |
| 2012/0013494 | A1 | 1/2012 | Song | |
| 2012/0014426 | A1 | 1/2012 | Azadet | |
| 2012/0232913 | A1 | 9/2012 | Terriberry | |
| 2013/0163894 | A1 | 6/2013 | Demos | |

FOREIGN PATENT DOCUMENTS

| | | |
|---|---|---|
| GB | 2466675 | 7/2010 |
| JP | 2004-525540 | 8/2004 |
| JP | 2016-519787 | 7/2016 |
| RU | 2011104784 | 8/2012 |
| WO | 2006/111294 | 10/2006 |
| WO | 2010/003556 | 1/2010 |
| WO | 2011/063694 | 6/2011 |
| WO | 2011/107434 | 9/2011 |
| WO | 2011/114933 | 9/2011 |
| WO | 2014/108393 | 7/2014 |

OTHER PUBLICATIONS

Floros, A. et al "Advances on Calculating Effective Dither for Audio Signals" Proc. of the 10th WSEAS International Conference on Systems, Vouliagmeni, Athens, Greece, Jul. 10-12, 2006 (pp. 614-618).

Gray, Robert M. et al "Quantization", IEEE Transactions on Information Theory, vol. 44, No. 6, Oct. 1, 1998.

Kohad, H. et al "An Overview of Speech Encryption Techniques" International Journal of Engineering Research and Development, vol. 3, Issue 4, Aug. 2012, pp. 29-32.

Rebollo-Monedero, David "Quantization and Transforms for Distributed Source Coding" Proquest Dissertations and Theses, Stanford University, Jun. 2008.

Schuchman, Leonard "Dither Signals and their Effect on Quantization Noise" IEEE Transactions on Communication Technology, vol. 12, Issue 4, pp. 162-165, Dec. 1964.

Zamir, R. et al "Information Rate of Pre/Post-Filtered Dithered Quantizers", IEEE Transactions on Information Theory, vol. 42, No. 5, Sep. 1, 1996.

* cited by examiner

901

902

903

ADVANCED QUANTIZER

CROSS REFERENCE TO RELATED APPLICATIONS

This application is a continuation of U.S. patent application Ser. No. 14/781,700, filed on Oct. 1, 2015, which is the U.S. national stage of International Patent Application No. PCT/EP2014/056855 filed on Apr. 4, 2014, which in turn claims priority to U.S. Provisional Patent Application No. 61/808,673, filed on Apr. 5, 2013 and U.S. Provisional Patent Application No. 61/875,817, filed on Sep. 10, 2013, each of which is hereby incorporated by reference in its entirety.

TECHNICAL FIELD

The present document relates an audio encoding and decoding system (referred to as an audio codec system). In particular, the present document relates to a transform-based audio codec system which is particularly well suited for voice encoding/decoding.

BACKGROUND

General purpose perceptual audio coders achieve relatively high coding gains by using transforms such as the Modified Discrete Cosine Transform (MDCT) with block sizes of samples which cover several tenths of milliseconds (e.g. 20 ms). An example for such a transform-based audio codec system is Advanced Audio Coding (AAC) or High Efficiency (HE)-AAC. However, when using such transform-based audio codec systems for voice signals, the quality of voice signals degrades faster than that of musical signals towards lower bitrates, especially in the case of dry (non-reverberant) speech signals.

The present document describes a transform-based audio codec system which is particularly well suited for the coding of speech signals. Furthermore, the present document describes a quantization schemes which may be used in such a transform-based audio codec system. Various different quantization schemes may be used in conjunction with transform-based audio codec systems. Examples are vector quantization (e.g., Twin vector quantization), distribution preserving quantization, dithered quantization, scalar quantization with a random offset, and scalar quantization combined with a noise-fill (e.g., the quantizer described in U.S. Pat. No. 7,447,631).

These different quantization schemes have various advantages and disadvantages with regards to one or more of the following attributes:

- operational (encoder) complexity, which typically includes the computational complexity of quantization and of generation of the bitstream (e.g., variable length coding);
- perceptual performance, which may be estimated based on theoretical considerations (rate-distortion performance) and based on features of the associated noise-filling behavior (e.g. at bit-rates that are practically relevant to low-rate transform coding of speech);
- complexity of the bit-rate allocation process in the presence of an overall bit-rate constraint (e.g., maximum number of bits); and/or
- flexibility with regards to enabling different data-rates and different distortion levels.

In the present document, a quantization scheme is described which addresses at least some of the above mentioned attributes. In particular, a quantization scheme is described which provides improved performance with regards to some or all of the above mentioned attributes.

SUMMARY

According to an aspect, a quantization unit (also referred to as a coefficient quantization unit in the present document) configured to quantize a first coefficient of a block of coefficients is described. The block of coefficients may correspond to or may be derived from a block of prediction residual coefficients (also referred to as a block of prediction error coefficients). As such, the quantization unit may be part of a transform-based audio encoder which makes use of subband prediction, as described in further detail below. In general terms, the block of coefficients may comprise a plurality of coefficients for a plurality of corresponding frequency bins. The block of coefficients may be derived from a block of transform coefficients, wherein the block of transform coefficients has been determined by converting an audio signal (e.g. a speech signal) from the time-domain to the frequency-domain using a time-domain to frequency-domain transform (e.g. a Modified Discrete Cosine Transform, MDCT).

It should be noted that the first coefficient of the block of coefficients may correspond to any one or more of the coefficients of the block of coefficients. The block of coefficients may comprise K coefficients ($K>1$, e.g. $K=256$). The first coefficient may correspond to any one of the $k=1, \ldots, K$ frequency coefficients. As will be outlined in the following, the plurality of K frequency bins may be grouped into a plurality of L frequency bands, with $1<L<K$. A coefficient of the block of coefficients may be assigned to one of the plurality of frequency bands ($1=1, \ldots, L$). The coefficients q, with $q=1, \ldots, Q$ and $0<Q<K$, which are assigned to a particular frequency band l may be quantized using the same quantizer. The first coefficient may correspond to the $q^{th}$ coefficient of the $l^{th}$ frequency band, for any $q=1, \ldots, Q$, and for any $l=1, \ldots, L$.

The quantization unit may be configured to provide a set of quantizers. The set of quantizers may comprise a plurality of different quantizers associated with a plurality of different signal-to-noise ratios (SNR) or a plurality of different distortion levels, respectively. As such, the different quantizers of the set of quantizers may yield respective SNRs or distortion levels. The quantizers within the set of quantizers may be ordered in accordance to the plurality of SNRs associated with the plurality of quantizers. In particular, the quantizers may be ordered such that the SNR which is obtained using a particular quantizer increases compared to the SNR which is obtained using a directly preceding adjacent quantizer.

The set of quantizers may also be referred to as a set of admissible quantizers. Typically, the number of quantizers comprised within the set of quantizers is limited to a number R of quantizers. The number R of quantizers comprised within the set of quantizers may be selected based on an overall SNR range which is to be covered by the set of quantizers (e.g. an SNR range from approx. 0 dB to 30 dB). Furthermore, the number R of quantizers typically depends on an SNR target difference between adjacent quantizers within an ordered set of quantizers. Typical values for the number R of quantizers are 10 to 20 quantizers.

The plurality of different quantizers may comprise a noise-filling quantizer, one or more dithered quantizers, and/or one or more un-dithered quantizers. In a preferred example, the plurality of different quantizers comprises a single noise-filling quantizer, one or more dithered quantizers and one or more un-dithered quantizers. As will be outlined in the present document, it is beneficial to use a noise-filling quantizer for a zero bit-rate situation (e.g. instead of using a dithered quantizer with a large quantization step size). The noise-filling quantizer is associated with the relatively lowest SNR of the plurality of SNRs, and the one or more un-dithered quantizers may be associated with the one or more relatively highest SNRs of the plurality of SNRs. The one or more dithered quantizers may be associated with one or more intermediate SNRs, which are higher than the relatively lowest SNR and which are lower than the one or more relatively highest SNRs of the plurality of SNRs. As such, the ordered set of quantizers may comprise a noise-filling quantizer for the lowest SNR (e.g. lower or equal to 0 dB), followed by one or more dithered quantizers for intermediate SNRs, and followed by one or more un-dithered quantizers for relatively high SNRs. By doing this, the perceptual quality of a reconstructed audio signal (derived from the block of quantized coefficients, quantized using the set of quantizers) may be improved. In particular, audible artifacts caused by spectral holes may be reduced, while at the same time keeping the MSE (mean square error) performance of the quantization unit high.

The noise-filling quantizer may comprise a random number generator configured to generate random numbers according to a pre-determined statistical model. The pre-determined statistical model of the random number generator of the noise-filling quantizer may depend on the side information (e.g. a variance preservation flag) which is available at the encoder and at a corresponding decoder. The noise-filling quantizer may be configured to quantize the first coefficient (or any of the coefficients of the block of coefficients) by replacing the first coefficient with a random number generated by the random number generator. The random number generator used at the quantization unit (e.g. at a local decoder comprised within an encoder) may be in sync with a corresponding random number generator at an inverse quantization unit (at a corresponding decoder). As such, the output of the noise-filling quantizer may be independent of the first coefficient, such that the output of the noise-filling quantizer may not require the transmission of any quantization indices. The noise-filling quantizer may be associated with an SNR that is (close to or substantially) 0 dB. In other words, the noise-filling quantizer may operate with an SNR that is close to 0 dB. During the rate allocation process, the noise-filling quantizer may be considered to provide a 0 dB SNR although in practice, its SNR may slightly deviate from zero (e.g. may be slightly lower than zero dB (due to synthesis of a signal that is independent from the input signal)).

The SNR of the noise-filling quantizer may be adjusted based on one or more additional parameters. For example, the variance of the noise-filling quantizer may be adjusted by setting the variance of the synthesized signal (i.e. the variance of the coefficients which have been quantized using the noise-filling quantizer) according to a predefined function of the predictor gain. Alternatively or in addition, the variance of the synthesized signal may be set by means of a flag which is transmitted in the bitstream. In particular, the variance of the noise-filling quantizer may be adjusted by means of one of the two predefined functions of the predictor gain ρ (provided further down within this document), where one of these functions may be selected to render the synthesized signal in dependence of the flag (e.g. in dependence of the variance preservation flag). By way of example, the variance of the signal generated by the noise-filling quantizer may be adjusted in such a way, so that the SNR of the noise-filling quantizer falls within the range [−3.0 dB to 0 dB]. An SNR at 0 dB is typically beneficial from a MMSE (minimum mean square error) perspective. On the other hand, the perceptual quality may be increased when using lower SNRs (e.g. down to −3.0 dB).

The one or more dithered quantizers are preferably subtractive dithered quantizers. In particular, a dithered quantizer of the one or more dithered quantizers may comprise a dither application unit configured to determine a first dithered coefficient by applying a dither value (also referred to as dither number) to the first coefficient. Furthermore, the dithered quantizer may comprise a scalar quantizer configured to determine a first quantization index by assigning the first dithered coefficient to an interval of the scalar quantizer. As such, the dithered quantizer may generate a first quantization index based on the first coefficient. In a similar manner one or more others of the coefficients of the block of coefficients may be quantized.

A dithered quantizer of the one or more dithered quantizers may further comprise an inverse scalar quantizer configured to assign a first reconstruction value to the first quantization index. Furthermore, the dithered quantizer may comprise a dither removal unit configured to determine a first de-dithered coefficient by removing the dither value (i.e. the same dither value which has been applied by the dither application unit) from the first reconstruction value.

Furthermore, the dithered quantizer may comprise a post-gain application unit configured to determine a first quantized coefficient by applying a quantizer post-gain γ to the first de-dithered coefficient. By applying the post-gain γ to the first de-dithered coefficient, the MSE performance of the dithered quantizer may be improved. The quantizer post-gain γ may be given by $$\gamma = \frac{\sigma_X^2}{\sigma_X^2 + \frac{\Delta^2}{12}},$$

with $\sigma^2_X = E\{X^2\}$ being a variance of one or more of the coefficients of the block of coefficients, and with Δ being a quantizer step size of the scalar quantizer of the dithered quantizer.

As such, the dithered quantizer may be configured to perform inverse quantization to yield a quantized coefficient. This may be used at the local decoder of an encoder, which facilitates a closed-loop prediction, e.g. where the prediction loop at the encoder is kept in sync with the prediction loop at the decoder.

The dither application unit may be configured to subtract the dither value from the first coefficient, and the dither removal unit may be configured to add the dither value to the first reconstruction value. Alternatively, the dither application unit may be configured to add the dither value to the first coefficient, and the dither removal unit may be configured to subtract the dither value from the first reconstruction value.

The quantization unit may further comprise a dither generator configured to generate a block of dither values. In order to facilitate synchronization between the encoder and the decoder, the dither values may be pseudo-random numbers. The block of dither values may comprise a plurality of dither values for the plurality of frequency bins, respectively. As such, the dither generator may be configured to generate a dither value for each one of the coefficients of the block of coefficients, which is to be quantized, regardless whether a particular coefficient is to be quantized using one of the dithered quantizers or not. This is beneficial for maintaining synchronicity between a dither generator used at an encoder and a dither generator used at a corresponding decoder.

The scalar quantizer of the dithered quantizer has a pre-determined quantizer step size Δ. As such, the scalar quantizer of the dithered quantizer may be a uniform quantizer. The dither values may take on values from a pre-determined dither interval. The pre-determined dither interval may have a width equal to or smaller than the pre-determined quantizer step size Δ. Furthermore, the block of dither values may be composed of realizations of a random variable uniformly distributed within the pre-determined dither interval. For example, the dither generator is configured to generate a block of dither values which are drawn from a normalized dither interval (e.g. [0, 1) or [−0.5, 0.5)). As such, the width of a normalized dither interval may be one. The block of dither values may then be multiplied with the pre-determined quantizer step size Δ of the particular dithered quantizer. By doing this, a dither realization suitable for using with the quantizer having a step size Δ may be obtained. In particular, by doing this, a quantizer fulfilling the so called Schuchman conditions is obtained (L. Schuchman, "Dither signals and their effect on quantization noise", IEEE TCOM, pp. 162-165, Dec. 1964.).

The dither generator may be configured to select one of M pre-determined dither realizations, wherein M is an integer greater than one. Furthermore, the dither generator may be configured to generate the block of dither values based on the selected dither realization. In particular, in some implementations, the number of dither realizations may be limited. By way of example, the number M of pre-determined dither realizations may be 10, 5, 4 or less. This may be beneficial with regards to subsequent entropy encoding of the quantization indices which have been obtained using the one or more dithered quantizers. In particular, the use of a limited number M of dither realizations enables an entropy encoder for the quantization indices to be trained based on the limited number of dither realizations. By doing this, one can use an instantaneous code (such, as for example, multidimensional Huffman coding), instead of arithmetic code, which can be advantageous in terms of operational complexity.

An un-dithered quantizer of the one or more un-dithered quantizers may be a scalar quantizer with a pre-determined uniform quantizer step size. As such, the one or more un-dithered quantizers may be deterministic quantizers, which do not make use of a (pseudo) random dither.

As outlined above, the set of quantizers may be ordered. This may be beneficial, in view of an efficient bit allocation process. In particular, the ordering of the set of quantizers enables the selection of a quantizer from the set of quantizers based on an integer index. The set of quantizers may be ordered such that the increase in SNR between adjacent quantizers is, at least approximately, constant. In other words, an SNR difference between two quantizers may be given by the difference of the SNRs associated with a pair of adjacent quantizers from the ordered set of quantizers. The SNR differences for all pairs of adjacent quantizers from the plurality of ordered quantizers may fall within a pre-determined SNR difference interval centered around a pre-determined SNR target difference. A width of the pre-determined SNR difference interval may be smaller than 10% or 5% of the pre-determined SNR target difference. The SNR target difference may be set in a way such that a relatively small set of quantizers can render operation at a relatively large overall SNR range. For example in typical applications the set of quantizers may facilitate operation within an interval from 0 dB SNR towards 30 dB SNR. The pre-determined SNR target difference may be set to 1.5 dB or 3 dB, thereby allowing the overall SNR range of 30 dB to be covered with a set of quantizers comprising 10 to 20 quantizers. As such, an increase of the integer index of a quantizer of the ordered set of quantizers directly translates into a corresponding SNR increase. This one-to-one relationship is beneficial for the implementation of an efficient bit allocation process, which allocates a quantizer with a particular SNR to a particular frequency band according to a given bit-rate constraint.

The quantization unit may be configured to determine an SNR indication indicative of an SNR attributed to the first coefficient. The SNR attributed to the first coefficient may be determined using a rate allocation process (also referred to as a bit allocation process). As indicated above, the SNR attributed to the first coefficient may directly identify a quantizer from the set of quantizers. As such, the quantization unit may be configured to select a first quantizer from the set of quantizers, based on the SNR indication. Furthermore, the quantization unit may be configured to quantize the first coefficient using the first quantizer. In particular, the quantization unit may be configured to determine a first quantization index for the first coefficient. The first quantization index may be entropy encoded and may be transmitted as coefficient data within a bitstream to a corresponding inverse quantization unit (of a corresponding decoder). Furthermore, the quantization unit may be configured to determine a first quantized coefficient from the first coefficient. The first quantized coefficient may be used within a predictor of the encoder.

The block of coefficients may be associated with a spectral block envelope (e.g. a current envelope or a quantized current envelope, as described below). In particular, the block of coefficients may be obtained by flattening a block of transform coefficients (derived from a segment of the input audio signal) using the spectral block envelope. The spectral block envelope may be indicative of a plurality of spectral energy values for the plurality of frequency bins. In particular, the spectral block envelope may be indicative of the relative importance of the coefficients of the block of coefficients. As such, the spectral block envelope (or an envelope derived from the spectral block envelope, such as the allocation envelope described below) may be used for rate allocation purposes. In particular, the SNR indication may depend on the spectral block envelope. The SNR indication may further depend on an offset parameter for offsetting the spectral block envelope. During a rate allocation process, the offset parameter may be increased/decreased until the coefficient data generated from the quantized and encoded block of coefficients meets a pre-determined bit-rate constraint (e.g. the offset parameter may be selected as large as possible such that the encoded block of coefficients does not exceed a pre-determined number of bits). Hence, the offset parameter may depend on a pre-determined number of bits available for encoding the block of coefficients.

The SNR indication which is indicative of the SNR attributed to the first coefficient may be determined by offsetting a value derived from the spectral block envelope associated with the frequency bin of the first coefficient using the offset parameter. In particular, a bit allocation formula as described in the present document may be used to determine the SNR indication. The bit allocation formula may be a function of an allocation envelope derived from the spectral block envelope and of the offset parameter.

As such, the SNR indication may depend on an allocation envelope derived from the spectral block envelope. The allocation envelope may have an allocation resolution (e.g. a resolution of 3 dB). The allocation resolution preferably depends on the SNR difference between adjacent quantizers from the set of quantizers. In particular, the allocation resolution and the SNR difference may correspond to one another. In an example, the SNR difference is 1.5 dB and the allocation resolution is 3 dB. By selecting corresponding allocation resolution and SNR difference (e.g. by selecting an allocation resolution which is twice the SNR difference, in the dB domain), the bit allocation process and/or the quantizer selection process may be simplified (using e.g. the bit allocation formula described in the present document.).

The plurality of coefficients of the block of coefficients may be assigned to a plurality of frequency bands. A frequency band may comprise one or more frequency bins. As such, more than one of the plurality of coefficients may be assigned to the same frequency band. Typically, the number of frequency bins per frequency band increases with increasing frequency. In particular, the frequency band structure (e.g. the number of frequency bins per frequency band) may follow psychoacoustic considerations. The quantization unit may be configured to select a quantizer from the set of quantizers for each of the plurality of frequency bands, such that coefficients which are assigned to a same frequency band are quantized using the same quantizer. The quantizer which is used for quantizing a particular frequency band may be determined based on the one or more spectral energy values of the spectral block envelope within the particular frequency band. The use of a frequency band structure for quantization purposes may be beneficial with regards to the psychoacoustic performance of the quantization scheme.

The quantization unit may be configured to receive side information indicative of a property of the block of coefficients. By way of example, the side information may comprise a predictor gain determined by a predictor comprised within an encoder comprising the quantization unit. The predictor gain may be indicative of tonal content of the block of coefficients. Alternatively or in addition, the side information may comprise a spectral reflection coefficient derived based on the block of coefficients and/or based on the spectral block envelope. The spectral reflection coefficient may be indicative of fricative content of the block of coefficients. The quantization unit may be configured to extract the side information from data, which is available at both the encoder and the decoder, comprising the quantization unit and at a corresponding decoder comprising a corresponding inverse quantization unit. As such, the transmission of the side information from the encoder to the decoder may not require additional bits.

The quantization unit may be configured to determine the set of quantizers in dependence of the side information. In particular, a number of dithered quantizers within the set of quantizers may depend on the side information. Even more particularly, the number of dithered quantizers comprised within the set of quantizers may decrease with increasing predictor gain, and vice versa. By making the set of quantizers dependent on the side information, the perceptual performance of the quantization scheme may be improved.

The side information may comprise a variance preservation flag. The variance preservation flag may be indicative of how a variance of the block of coefficients is to be adjusted. In other words, the variance preservation flag may be indicative of processing to be performed by the decoder, which has an impact on the variance of the block of coefficients which is to be reconstructed by the quantizer.

By way of example, the set of quantizers may be determined in dependence of the variance preservation flag. In particular, a noise gain of the noise-filling quantizer may be dependent on the variance preservation flag. Alternatively or in addition, the one or more dithered quantizers may cover an SNR range and the SNR range may be determined in dependence on the variance preservation flag. Furthermore, the post-gain $\gamma$ may be dependent on the variance preservation flag. Alternatively or in addition, the post-gain $\gamma$ of the dithered quantizer may be determined in dependence of a parameter that is a predefined function of the predictor gain.

The variance preservation flag may be used to adapt the degree of noisiness of the quantizers to the quality of the prediction. By way of example, the post-gain $\gamma$ of the dithered quantizer may be determined in dependence of a parameter that is a predefined function of the predictor gain. Alternatively or in addition, the post-gain $\gamma$ may be determined by means of a comparison of a variance preserving post-gain scaled by a predefined function of the predictor gain to a mean-squared error optimal post gain and selecting the largest of the two gains. In particular, the predefined function of the predictor gain may reduce the variance of the reconstructed signal as the predictor gain increases. As a result of this, the perceptual quality of the codec may be improved.

According to a further aspect, an inverse quantization unit (also referred to as a spectrum decoder in the present document) configured to de-quantize a first quantization index of a block of quantization indices is described. In other words, the inverse quantization unit may be configured to determine reconstruction values for a block of coefficients, based on coefficient data (e.g. based on quantization indices). It should be noted that all the features and aspects which have been described in the present document in the context of a quantization unit are also applicable to the corresponding inverse quantization unit. In particular, this applies to the features relating to the structure and the design of the set of quantizers, to the dependence of the set of quantizers on side information, to the bit allocation process, etc.

The quantization indices may be associated with a block of coefficients comprising a plurality of coefficients for a plurality of corresponding frequency bins. In particular, the quantization indices may be associated with quantized coefficients (or reconstruction values) of a corresponding block of quantized coefficients. As outlined in the context of the corresponding quantization unit, the block of quantized coefficients may correspond to or may be derived from a block of prediction residual coefficients. More generally, the block of quantized coefficients may have been derived from a block of transform coefficients, which has been obtained from a segment of an audio signal using a time-domain to frequency-domain transform.

The inverse quantization unit may be configured to provide a set of quantizers. As outlined above, the set of quantizers may be adapted or generated based on side information which is available at the inverse quantization unit and at the corresponding quantization unit. The set of quantizers typically comprises a plurality of different quantizers associated with a plurality of different signal-to-noise ratios (SNR), respectively. Furthermore, the set of quantizers may be ordered according to increasing/decreasing SNR as outlined above. The SNR increase/decrease between adjacent quantizers may be substantially constant.

The plurality of different quantizers may comprise a noise-filling quantizer which corresponds to the noise-filling quantizer of the quantization unit. In a preferred example, the plurality of different quantizers comprises a single noise-filling quantizer. The noise filling quantizer of the inverse quantization unit is configured to provide a reconstruction of the first coefficient by using a realization of a random variable generated according to a prescribed statistical model. As such, it should be noted that the block of quantization indices typically does not comprise any quantization indices for the coefficients which are to be reconstructed using the noise filling quantizer. Hence, the coefficients which are to be reconstructed using the noise filling quantizer are associated with zero bit-rate.

Furthermore, the plurality of different quantizers may comprise one or more dithered quantizers. The one or more dithered quantizers may comprise one or more respective inverse scalar quantizers configured to assign a first reconstruction value to the first quantization index. Furthermore, the one or more dithered quantizers may comprise one or more respective dither removal units configured to determine a first de-dithered coefficient by removing the dither value from the first reconstruction value. The dither generator of the inverse quantization unit is typically in sync with the dither generator of the quantization unit. As outlined in the context of the quantization unit, the one or more dithered quantizers preferably applies a quantizer post-gain, in order to improve the MSE performance of the one or more dithered quantizers.

In addition, the plurality of quantizers may comprise one or more un-dithered quantizers. The one or more un-dithered quantizers may comprise respective uniform scalar quantizers which are configured to assign respective reconstruction values to the first quantization index (without performing a subsequent dither removal and/or without applying a quantizer post-gain).

Furthermore, the inverse quantization unit may be configured to determine an SNR indication indicative of a SNR attributed to a first coefficient from the block of coefficients (or to a first quantized coefficient from the block of quantized coefficients). The SNR indication may be determined based on the spectral block envelope (which is typically also available at the decoder comprising the inverse quantization unit) and based on the offset parameter (which is typically included into the bitstream transmitted from the encoder to the decoder). In particular, the SNR indication may be indicative of an index number of an inverse quantizer (or a quantizer) to be selected from the set of quantizers. The inverse quantization unit may proceed in selecting a first quantizer from the set of quantizers, based on the SNR indication. As outlined in the context of the corresponding quantization unit, this selection process may be implemented in an efficient manner, when using an ordered set of quantizers. In addition, the inverse quantization unit may be configured to determine a first quantized coefficient for the first coefficient using the selected first quantizer.

According to a further aspect, a transform-based audio encoder configured to encode an audio signal into a bitstream is described. The encoder may comprise a quantization unit configured to determine a plurality of quantization indices by quantizing a plurality of coefficients from a block of coefficients. The quantization unit may comprise one or more dithered quantizers. The quantization unit may comprise any of the quantization unit related features described in the present document.

The plurality of coefficients may be associated with a plurality of corresponding frequency bins. As outlined above, the block of coefficients may have been derived from a segment of the audio signal. In particular, the segment of the audio signal may have been transformed from the time-domain to the frequency-domain to yield a block of transform coefficients. The block of coefficients which are quantized by the quantization unit may have been derived from the block of transform coefficients.

The encoder may further comprise a dither generator configured to select a dither realization. Furthermore, the encoder may comprise an entropy coder configured to select a codeword based on a predefined statistical model of a transform coefficient, where the statistical model (i.e. probability distribution function) of the transform coefficients may be further conditioned on the realization of the dither. Such a statistical model may then be used to compute a probability of a quantization index, in particular a probability of the quantization index conditioned on the realization of the dither corresponding to the coefficient. The probability of the quantization index may be used to generate a binary codeword that is associated with this quantization index. Furthermore, a sequence of quantization indices may be encoded jointly based on their respective probabilities, where the respective probabilities may be conditioned on the respective dither realizations. For example, such joint encoding of a sequence of quantization indices may be implemented by means of arithmetic coding or range coding.

According to another aspect the encoder may comprise a dither generator configured to select one of a plurality of pre-determined dither realizations. The plurality of pre-determined dither realizations may comprise M different pre-determined dither realizations. Furthermore, the dither generator may be configured to generate a plurality of dither values for quantizing the plurality of coefficients, based on the selected dither realization. M may be an integer greater than one. In particular, the number M of pre-determined dither realizations may be 10, 5, 4 or less. The dither generator may comprise any of the dither generator related features described in the present document.

Furthermore, the encoder may comprise an entropy encoder configured to select a codebook from M pre-determined codebooks. The entropy encoder may be further configured to entropy encode the plurality of quantization indices using the selected codebook. The M pre-determined codebooks may be associated with the M pre-determined dither realizations, respectively. In particular, the M pre-determined codebooks may have been trained using the M pre-determined dither realizations, respectively. The M pre-determined codebooks may comprise variable-length Huffman codewords.

The entropy encoder may be configured to select the codebook associated with the dither realization selected by the dither generator. In other words, the entropy encoder may select a codebook for entropy encoding, which is associated with (e.g. which has been trained for) the dither realization used to generate the plurality of quantization indices. By doing this, the coding gain of the entropy encoder may be improved (e.g. optimized), even when using dithered quantizers. It has been observed by the inventors that the perceptual benefits of using dithered quantizers may be achieved even when using a relatively small number M of dither realizations. Consequently, only a relatively small number M of codebooks is to be provided in order to allow for optimized entropy encoding.

Coefficient data indicative of the entropy encoded quantization indices is typically inserted into the bitstream, for transmission or provision to the corresponding decoder.

According to a further aspect, a transform-based audio decoder configured to decode a bitstream to provide a reconstructed audio signal is described. It should be noted that the features and aspects described in the context of the corresponding audio encoder are also applicable to the audio decoder. In particular, the aspects relating to the use of a limited number M of dither realizations and a corresponding limited number M of codebooks are also applicable to the audio decoder.

The audio decoder comprises a dither generator configured to select one of M pre-determined dither realizations. The M pre-determined dither realizations are the same as the M pre-determined dither realizations used by the corresponding encoder. Furthermore, the dither generator may be configured to generate a plurality of dither values based on the selected dither realization. M may be an integer greater than one. By way of example, M may be in the range of 10 or 5. The plurality of dither values may be used by an inverse quantization unit comprising one or more dithered quantizers which are configured to determine a corresponding plurality of quantized coefficients based on a corresponding plurality of quantization indices. The dither generator and the inverse quantization unit may comprise any of the dither generator related and inverse quantization unit related features described in the present document, respectively.

Furthermore, the audio decoder may comprise an entropy decoder configured to select a codebook from M pre-determined codebooks. The M pre-determined codebooks are the same as the codebooks used by the corresponding encoder. In addition, the entropy decoder may be configured to entropy decode coefficient data from the bitstream using the selected codebook, to provide the plurality of quantization indices. The M pre-determined codebooks may be associated with the M pre-determined dither realizations, respectively. The entropy decoder may be configured to select the codebook associated with the dither realization selected by the dither generator. The reconstructed audio signal is determined based on the plurality of quantized coefficients.

According to a further aspect, a transform-based speech encoder configured to encode a speech signal into a bitstream is described. As already indicated above, the encoder may comprise any of the encoder related features and/or components described in the present document. In particular, the encoder may comprise a framing unit configured to receive a plurality of sequential blocks of transform coefficients. The plurality of sequential blocks comprises a current block and one or more previous blocks. Furthermore, the plurality of sequential blocks is indicative of samples of the speech signal. In particular, the plurality of sequential blocks may have been determined using a time-domain to frequency-domain transform, such as a Modified Discrete Cosine Transform (MDCT). As such, a block of transform coefficients may comprise MDCT coefficients. The number of transform coefficients may be limited. By way of example, a block of transform coefficients may comprise 256 transform coefficients in 256 frequency bins.

In addition, the speech encoder may comprise a flattening unit configured to determine a current block of flattened transform coefficients by flattening the corresponding current block of transform coefficients using a corresponding current (spectral) block envelope (e.g. the corresponding adjusted envelope). Furthermore, the speech encoder may comprise a predictor configured to predict a current block of estimated flattened transform coefficients based on one or more previous blocks of reconstructed transform coefficients and based on one or more predictor parameters. In addition, the speech encoder may comprise a difference unit configured to determine a current block of prediction error coefficients based on the current block of flattened transform coefficients and based on the current block of estimated flattened transform coefficients.

The predictor may be configured to determine the current block of estimated flattened transform coefficients using a weighted mean squared error criterion (e.g. by minimizing a weighted mean squared error criterion). The weighted mean squared error criterion may take into account the current block envelope or some predefined function of the current block envelope as weights. In the present document, various different ways for determining the predictor gain using a weighted means squared error criterion are described.

Furthermore, the speech encoder may comprise a quantization unit configured to quantize coefficients derived from the current block of prediction error coefficients, using a set of pre-determined quantizers. The quantization unit may comprise any of the quantization related features described in the present document. In particular, the quantization unit may be configured to determine coefficient data for the bitstream based on the quantized coefficients. As such, the coefficient data may be indicative of a quantized version of the current block of prediction error coefficients.

The transform-based speech encoder may further comprise a scaling unit configured to determine a current block of rescaled prediction residual coefficients (also referred to as a block of rescaled error coefficients) based on the current block of prediction error coefficients using one or more scaling rules. The current block of rescaled error coefficient may be determined such and/or the one or more scaling rules may be such that in average a variance of the rescaled error coefficients of the current block of rescaled error coefficients is higher than a variance of the prediction error coefficients of the current block of prediction error coefficients. In particular, the one or more scaling rules may be such that the variance of the prediction error coefficients is closer to unity for all frequency bins or frequency bands. The quantization unit may be configured to quantize the rescaled error prediction residual coefficients of the current block of rescaled error coefficients, to provide the coefficient data (i.e., quantization indices for the coefficients).

The current block of prediction error coefficients typically comprises a plurality of prediction error coefficients for the corresponding plurality of frequency bins. The scaling gains which are applied by the scaling unit to the prediction error coefficients in accordance to the scaling rule may be dependent on the frequency bins of the respective prediction error coefficients.

Furthermore, the scaling rule may be dependent on the one or more predictor parameters, e.g. on the predictor gain. Alternatively or in addition, the scaling rule may be dependent on the current block envelope. In the present document, various different ways for determining a frequency bin —dependent scaling rule are described.

The transform-based speech encoder may further comprise a bit allocation unit configured to determine an allocation vector based on the current block envelope. The allocation vector may be indicative of a first quantizer from the set of quantizers to be used to quantize a first coefficient derived from the current block of prediction error coefficients. In particular, the allocation vector may be indicative of quantizers to be used for quantizing all of the coefficients derived from the current block of prediction error coefficients, respectively. By way of example, the allocation vector may be indicative of a different quantizer to be used for each frequency band ($l=1, \ldots, L$).

In other words, the bit allocation unit may be configured to determine an allocation vector based on the current block envelope and given a maximum bit-rate constraint. The bit allocation unit may be configured to determine the allocation vector also based on the one or more scaling rules. The dimensionality of the rate allocation vector is typically equal to the number L of frequency bands. An entry of the allocation vector may be indicative of an index of a quantizer from the set of quantizers to be used to quantize the coefficients belonging to a frequency band associated with the respective entry of the rate allocation vector. In particular, the allocation vector may be indicative of quantizers to be used for quantizing all of the coefficients derived from the current block of prediction error coefficients, respectively.

The bit allocation unit may be configured to determine the allocation vector such that the coefficient data for the current block of prediction error coefficients does not exceed a pre-determined number of bits. Furthermore, the bit allocation unit may be configured to determine an offset parameter indicative of an offset to be applied to an allocation envelope derived from the current block envelope (e.g. derived from a current adjusted envelope). The offset parameter may be included into the bitstream to enable the corresponding decoder to identify the quantizers which have been used to determine the coefficient data.

The transform-based speech encoder may further comprise an entropy encoder configured to entropy encode the quantization indices associated with the quantized coefficients. The entropy encoder may be configured to encode the quantization indices using an arithmetic encoder. Alternatively, the entropy encoder may be configured to encode the quantization indices using a plurality of M pre-determined codebooks (as described in the present document).

According to another aspect, a transform-based speech decoder configured to decode a bitstream to provide a reconstructed speech signal is described. The speech decoder may comprise any of the features and/or components described in the present document. In particular, the decoder may comprise a predictor configured to determine a current block of estimated flattened transform coefficients based on one or more previous blocks of reconstructed transform coefficients and based on one or more predictor parameters derived from the bitstream. Furthermore, the speech decoder may comprise an inverse quantization unit configured to determine a current block of quantized prediction error coefficients (or a rescaled version thereof) based on coefficient data comprised within the bitstream, using a set of quantizers. In particular, the inverse quantization unit may make use of a set of (inverse) quantizers corresponding to the set of quantizers used by the corresponding speech encoder.

The inverse quantization unit may be configured to determine the set of quantizers (and/or the corresponding set of inverse quantizers) in dependence of side information derived from the received bitstream. In particular, the inverse quantization unit may perform the same selection process for the set of quantizers as the quantization unit of the corresponding speech encoder. By making the set of quantizers dependent on the side information, the perceptual quality of the reconstructed speech signal may be improved.

According to another aspect, a method for quantizing a first coefficient of a block of coefficients is described. The block of coefficients comprises a plurality of coefficients for a plurality of corresponding frequency bins. The method may comprise providing a set of quantizers, wherein the set of quantizers comprises a plurality of different quantizers associated with a plurality of different signal-to-noise ratios (SNR), respectively. The plurality of different quantizers may comprise a noise-filling quantizer, one or more dithered quantizers, and one or more un-dithered quantizers. The method may further comprise determining an SNR indication indicative of a SNR attributed to the first coefficient. Furthermore, the method may comprise selecting a first quantizer from the set of quantizers, based on the SNR indication, and quantizing the first coefficient using the first quantizer.

According to a further aspect, a method for de-quantizing quantization indices is described. In other words, the method may be directed at determining reconstruction values (also referred to as quantized coefficients) for a block of coefficients, which have been quantized using a corresponding method for quantizing. A reconstruction value may be determined based on a quantization index. It should be noted, however, that some of the coefficients from the block of coefficients may have been quantized using a noise-filling quantizer. In this case, the reconstruction values for these coefficients may be determined independent of a quantization index.

As outlined above, the quantization indices are associated with a block of coefficients comprising a plurality of coefficients for a plurality of corresponding frequency bins. In particular, the quantization indices may correspond in a one-to-one relationship with those coefficients of the block of coefficients which have not been quantized using the noise-filling quantizer. The method may comprise providing a set of quantizers (or inverse quantizers). The set of quantizers may comprise a plurality of different quantizers associated with a plurality of different signal-to-noise ratios (SNR), respectively. The plurality of different quantizers may include a noise-filling quantizer, one or more dithered quantizers, and/or one or more un-dithered quantizers. The method may comprise determining an SNR indication indicative of a SNR attributed to a first coefficient of the block of coefficients. The method may proceed in selecting a first quantizer from the set of quantizers, based on the SNR indication, and in determining a first quantized coefficient (i.e. a reconstruction value) for the first coefficient of the block of coefficients.

According to another aspect, a method for encoding an audio signal into a bitstream is described. The method comprises determining a plurality of quantization indices by quantizing a plurality of coefficients from a block of coefficients using a dithered quantizer. The plurality of coefficients may be associated with a plurality of corresponding frequency bins. The block of coefficients may be derived from the audio signal. The method may comprise selecting one of M pre-determined dither realizations, and generating a plurality of dither values for quantizing the plurality of coefficients, based on the selected dither realization; wherein M is an integer greater one. Furthermore, the method may comprise selecting a codebook from M pre-determined codebooks, and entropy encoding the plurality of quantization indices using the selected codebook. The M pre-determined codebooks may be associated with the M pre-determined dither realizations, respectively, and the selected codebook may be associated with the selected dither realization. Furthermore, the method may comprise inserting coefficient data indicative of the entropy encoded quantization indices into the bitstream.

According to a further aspect, a method for decoding a bitstream to provide a reconstructed audio signal is described. The method may comprise selecting one of M pre-determined dither realizations, and generating a plurality of dither values based on the selected dither realization;

wherein M is an integer greater one. The plurality of dither values may be used by an inverse quantization unit comprising a dithered quantizer to determine a corresponding plurality of quantized coefficients based on a corresponding plurality of quantization indices. As such, the method may comprise determining the plurality of quantized coefficients using a dithered (inverse) quantizer. In addition, the method may comprise selecting a codebook from M pre-determined codebooks, and entropy decoding coefficient data from the bitstream using the selected codebook, to provide the plurality of quantization indices. The M pre-determined codebooks may be associated with the M pre-determined dither realizations, respectively, and the selected codebook may be associated with the selected dither realization. In addition, the method may comprise determining the reconstructed audio signal based on the plurality of quantized coefficients.

According to a further aspect, a method for encoding a speech signal into a bitstream is described. The method may comprise receiving a plurality of sequential blocks of transform coefficients comprising a current block and one or more previous blocks. The plurality of sequential blocks may be indicative of samples of the speech signal. Furthermore, the method may comprise determining a current block of estimated transform coefficients based on one or more previous blocks of reconstructed transform coefficients and based on a predictor parameter. The one or more previous blocks of reconstructed transform coefficients may have been derived from the one or more previous blocks of transform coefficients. The method may proceed in determining a current block of prediction error coefficients based on the current block of transform coefficients and based on the current block of estimated transform coefficients. Furthermore, the method may comprise quantizing coefficients derived from the current block of prediction error coefficients, using a set of quantizers. The set of quantizers may exhibit any of the features described in the present document. Furthermore, the method may comprise determining coefficient data for the bitstream based on the quantized coefficients.

According to another aspect, a method for decoding a bitstream to provide a reconstructed speech signal is described. The method may comprise determining a current block of estimated transform coefficients based on one or more previous blocks of reconstructed transform coefficients and based on a predictor parameter derived from the bitstream. Furthermore, the method may comprise determining a current block of quantized prediction residual coefficients based on coefficient data comprised within the bitstream, using a set of quantizers. The set of quantizers may have any of the features described in the present document. The method may proceed in determining a current block of reconstructed transform coefficients based on the current block of estimated transform coefficients and based on the current block of quantized prediction error coefficients. The reconstructed speech signal may be determined based on the current block of reconstructed transform coefficients.

According to a further aspect, a software program is described. The software program may be adapted for execution on a processor and for performing the method steps outlined in the present document when carried out on the processor.

According to another aspect, a storage medium is described. The storage medium may comprise a software program adapted for execution on a processor and for performing the method steps outlined in the present document when carried out on the processor.

According to a further aspect, a computer program product is described. The computer program may comprise executable instructions for performing the method steps outlined in the present document when executed on a computer.

It should be noted that the methods and systems including its preferred embodiments as outlined in the present patent application may be used stand-alone or in combination with the other methods and systems disclosed in this document. Furthermore, all aspects of the methods and systems outlined in the present patent application may be combined in various ways. In particular, the features of the claims may be combined with one another in an arbitrary manner.

SHORT DESCRIPTION OF THE FIGURES

The invention is explained below in an exemplary manner with reference to the accompanying drawings, wherein FIG. 1*a* shows a block diagram of an example audio encoder providing a bitstream at a constant bit-rate;

FIG. 1*b* shows a block diagram of an example audio encoder providing a bitstream at a variable bit-rate;

FIG. 2 illustrates the generation of an example envelope based on a plurality of blocks of transform coefficients;

FIG. 3*a* illustrates example envelopes of blocks of transform coefficients;

FIG. 3*b* illustrates the determination of an example interpolated envelope;

FIG. 4 illustrates example sets of quantizers;

FIG. 5*a* shows a block diagram of an example audio decoder;

FIG. 5*b* shows a block diagram of an example envelope decoder of the audio decoder of FIG. 5*a;*

FIG. 5*c* shows a block diagram of an example subband predictor of the audio decoder of FIG. 5*a;*

FIG. 5*d* shows a block diagram of an example spectrum decoder of the audio decoder of FIG. 5*a;*

FIG. 6*a* shows a block diagram of an example set of admissible quantizers;

FIG. 6*b* shows a block diagram of an example dithered quantizer;

FIG. 6*c* illustrates an example selection of quantizers based on the spectrum of a block of transform coefficients;

Figure 9A:
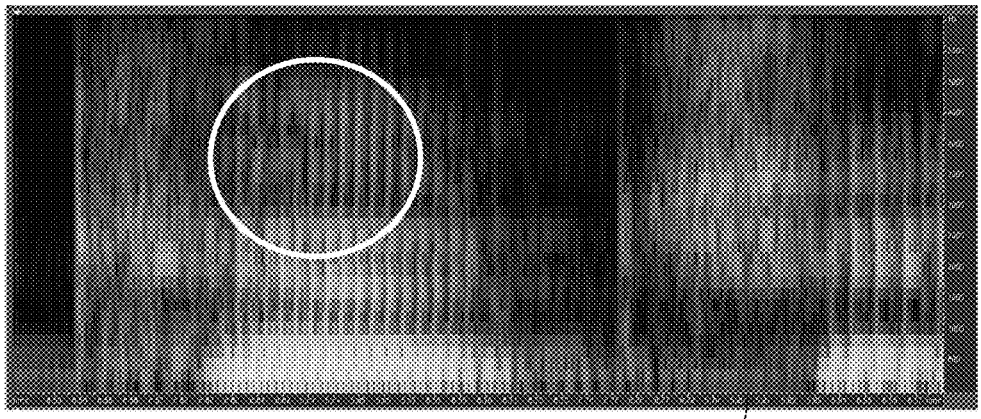
Figure 9B:
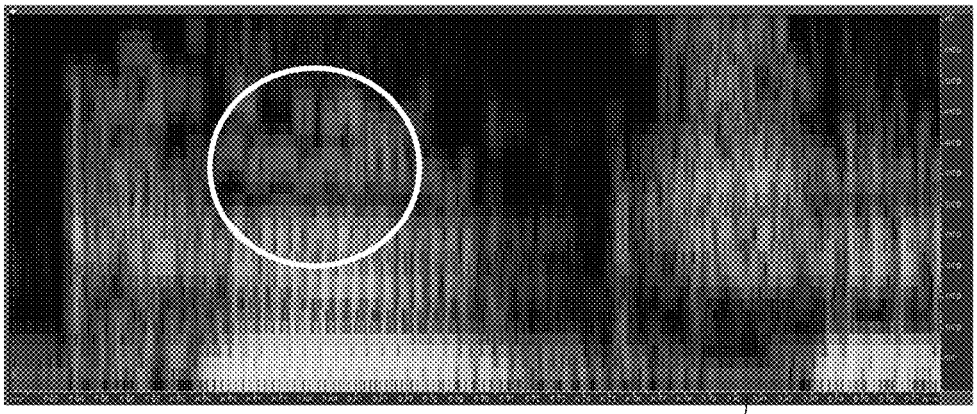
Figure 9C:
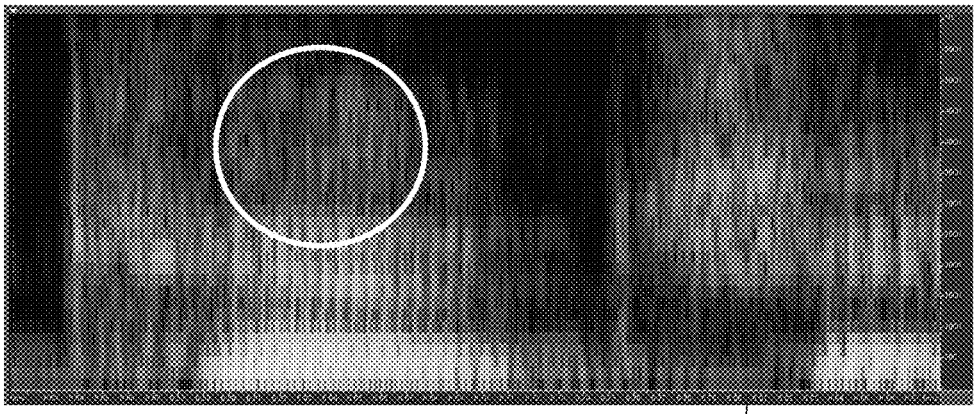

FIGS. 9*a* to 9*c* show example experimental results; and

Figure 10:
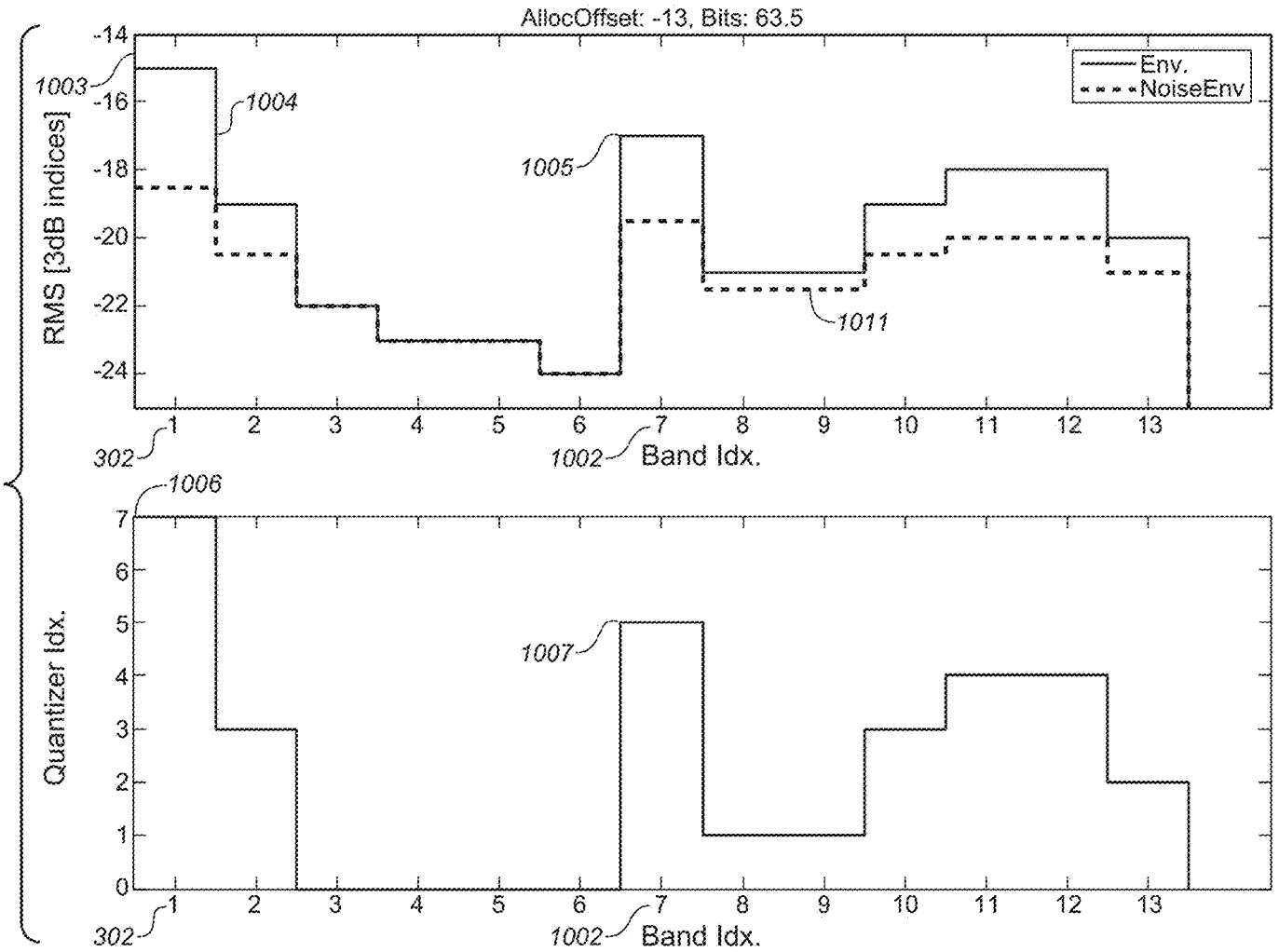

FIG. 10 illustrates an example bit allocation process.

DETAILED DESCRIPTION

As outlined in the background section, it is desirable to provide a transform-based audio codec which exhibits relatively high coding gains for speech or voice signals. Such a transform-based audio codec may be referred to as a transform-based speech codec or a transform-based voice codec. A transform-based speech codec may be conveniently combined with a generic transform-based audio codec, such as AAC or HE-AAC, as it also operates in the transform domain. Furthermore, the classification of a segment (e.g. a frame) of an input audio signal into speech or non-speech, and the subsequent switching between the generic audio codec and the specific speech codec may be simplified, due to the fact that both codecs operate in the transform domain.

Figure 1A:
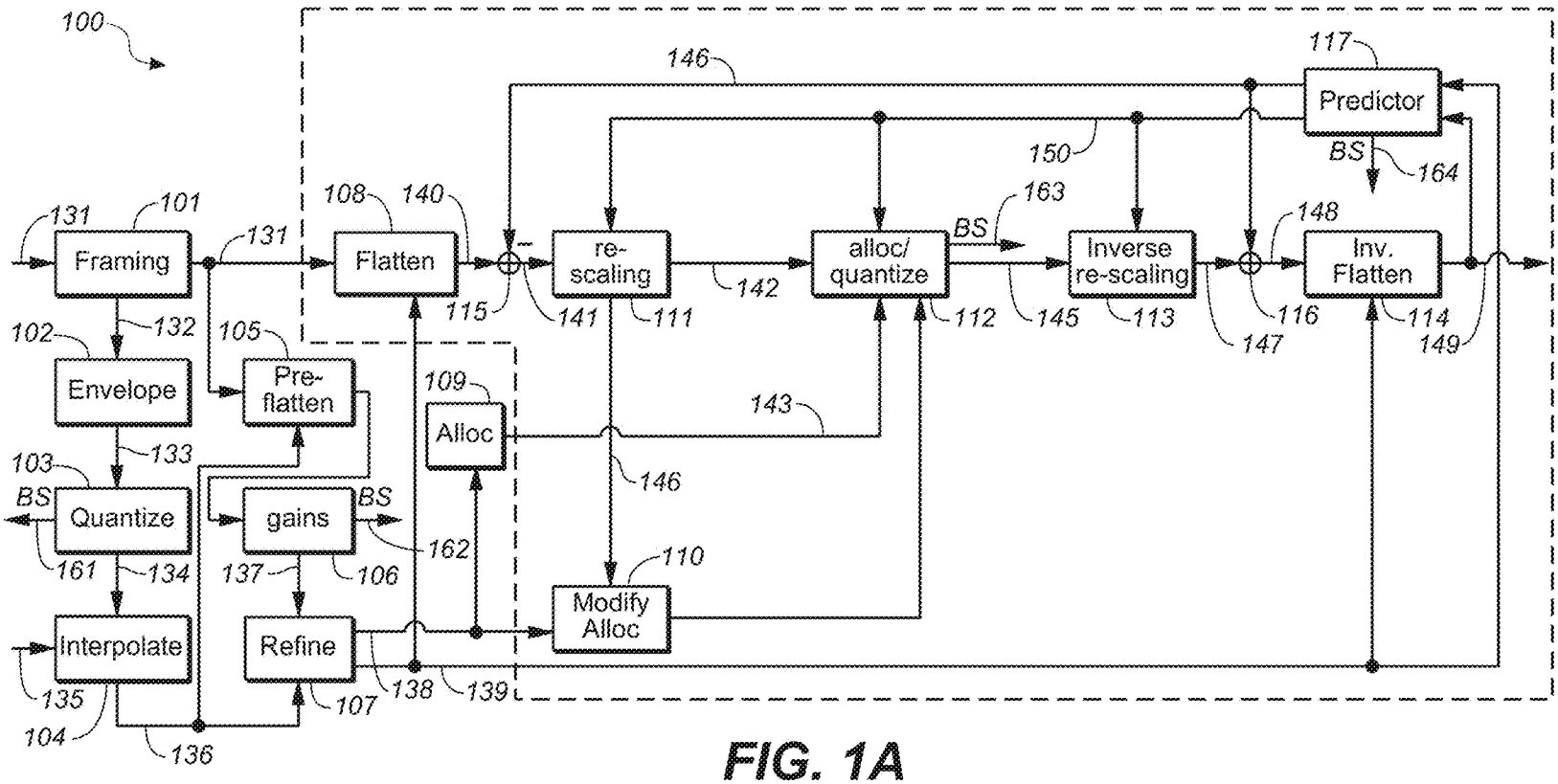

FIG. 1*a* shows a block diagram of an example transform-based speech encoder 100. The encoder 100 receives as an input a block 131 of transform coefficients (also referred to as a coding unit). The block 131 of transform coefficient may have been obtained by a transform unit configured to transform a sequence of samples of the input audio signal from the time domain into the transform domain. The transform unit may be configured to perform an MDCT. The transform unit may be part of a generic audio codec such as AAC or HE-AAC. Such a generic audio codec may make use of different block sizes, e.g. a long block and a short block. Example block sizes are 1024 samples for a long block and 256 samples for a short block. Assuming a sampling rate of 44.1 kHz and an overlap of 50%, a long block covers approx. 20 ms of the input audio signal and a short block covers approx. 5 ms of the input audio signal. Long blocks are typically used for stationary segments of the input audio signal and short blocks are typically used for transient segments of the input audio signal.

Speech signals may be considered to be stationary in temporal segments of about 20 ms. In particular, the spectral envelope of a speech signal may be considered to be stationary in temporal segments of about 20 ms. In order to be able to derive meaningful statistics in the transform domain for such 20 ms segments, it may be useful to provide the transform-based speech encoder 100 with short blocks 131 of transform coefficients (having a length of e.g. 5 ms).

By doing this, a plurality of short blocks 131 may be used to derive statistics regarding a time segments of e.g. 20 ms (e.g. the time segment of a long block). Furthermore, this has the advantage of providing an adequate time resolution for speech signals.

Hence, the transform unit may be configured to provide short blocks 131 of transform coefficients, if a current segment of the input audio signal is classified to be speech. The encoder 100 may comprise a framing unit 101 configured to extract a plurality of blocks 131 of transform coefficients, referred to as a set 132 of blocks 131. The set 132 of blocks may also be referred to as a frame. By way of example, the set 132 of blocks 131 may comprise four short blocks of 256 transform coefficients, thereby covering approx. a 20 ms segment of the input audio signal.

The set 132 of blocks may be provided to an envelope estimation unit 102. The envelope estimation unit 102 may be configured to determine an envelope 133 based on the set 132 of blocks. The envelope 133 may be based on root means squared (RMS) values of corresponding transform coefficients of the plurality of blocks 131 comprised within the set 132 of blocks. A block 131 typically provides a plurality of transform coefficients (e.g. 256 transform coefficients) in a corresponding plurality of frequency bins 301 (see FIG. 3*a*). The plurality of frequency bins 301 may be grouped into a plurality of frequency bands 302. The plurality of frequency bands 302 may be selected based on psychoacoustic considerations. By way of example, the frequency bins 301 may be grouped into frequency bands 302 in accordance to a logarithmic scale or a Bark scale. The envelope 134 which has been determined based on a current set 132 of blocks may comprise a plurality of energy values for the plurality of frequency bands 302, respectively. A particular energy value for a particular frequency band 302 may be determined based on the transform coefficients of the blocks 131 of the set 132, which correspond to frequency bins 301 falling within the particular frequency band 302. The particular energy value may be determined based on the RMS value of these transform coefficients. As such, an envelope 133 for a current set 132 of blocks (referred to as a current envelope 133) may be indicative of an average envelope of the blocks 131 of transform coefficients comprised within the current set 132 of blocks, or may be indicative of an average envelope of blocks 132 of transform coefficients used to determine the envelope 133.

Figure 2:
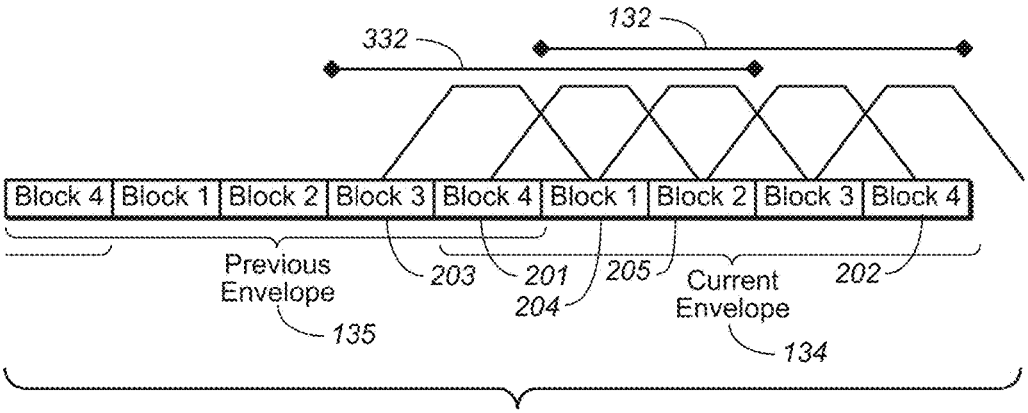

It should be noted that the current envelope 133 may be determined based on one or more further blocks 131 of transform coefficients adjacent to the current set 132 of blocks. This is illustrated in FIG. 2, where the current envelope 133 (indicated by the quantized current envelope 134) is determined based on the blocks 131 of the current set 132 of blocks and based on the block 201 from the set of blocks preceding the current set 132 of blocks. In the illustrated example, the current envelope 133 is determined based on five blocks 131. By taking into account adjacent blocks when determining the current envelope 133, a continuity of the envelopes of adjacent sets 132 of blocks may be ensured.

When determining the current envelope 133, the transform coefficients of the different blocks 131 may be weighted. In particular, the outermost blocks 201, 202 which are taken into account for determining the current envelope 133 may have a lower weight than the remaining blocks 131. By way of example, the transform coefficients of the outermost blocks 201, 202 may be weighted with 0.5, wherein the transform coefficients of the other blocks 131 may be weighted with 1.

It should be noted that in a similar manner to considering blocks 201 of a preceding set 132 of blocks, one or more blocks (so called look-ahead blocks) of a directly following set 132 of blocks may be considered for determining the current envelope 133.

The energy values of the current envelope 133 may be represented on a logarithmic scale (e.g. on a dB scale). The current envelope 133 may be provided to an envelope quantization unit 103 which is configured to quantize the energy values of the current envelope 133. The envelope quantization unit 103 may provide a pre-determined quantizer resolution, e.g. a resolution of 3 dB. The quantization indices of the envelope 133 may be provided as envelope data 161 within a bitstream generated by the encoder 100. Furthermore, the quantized envelope 134, i.e. the envelope comprising the quantized energy values of the envelope 133, may be provided to an interpolation unit 104.

Figure 3A:
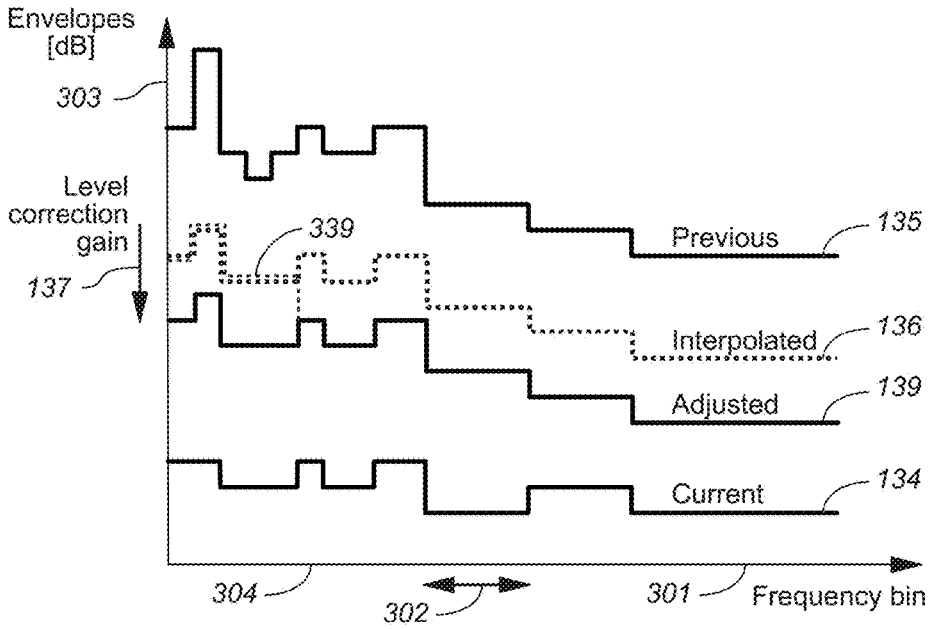
Figure 3B:
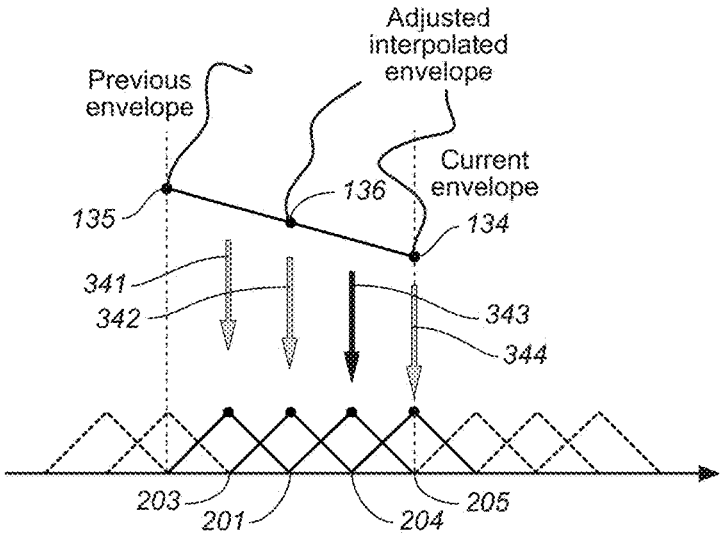

The interpolation unit 104 is configured to determine an envelope for each block 131 of the current set 132 of blocks based on the quantized current envelope 134 and based on the quantized previous envelope 135 (which has been determined for the set 132 of blocks directly preceding the current set 132 of blocks). The operation of the interpolation unit 104 is illustrated in FIGS. 2, 3*a* and 3*b*. FIG. 2 shows a sequence of blocks 131 of transform coefficients. The sequence of blocks 131 is grouped into succeeding sets 132 of blocks, wherein each set 132 of blocks is used to determine a quantized envelope, e.g. the quantized current envelope 134 and the quantized previous envelope 135. FIG. 3*a* shows examples of a quantized previous envelope 135 and of a quantized current envelope 134. As indicated above, the envelopes may be indicative of spectral energy 303 (e.g. on a dB scale). Corresponding energy values 303 of the quantized previous envelope 135 and of the quantized current envelope 134 for the same frequency band 302 may be interpolated (e.g. using linear interpolation) to determine an interpolated envelope 136. In other words, the energy values 303 of a particular frequency band 302 may be interpolated to provide the energy value 303 of the interpolated envelope 136 within the particular frequency band 302.

It should be noted that the set of blocks for which the interpolated envelopes 136 are determined and applied may differ from the current set 132 of blocks, based on which the quantized current envelope 134 is determined. This is illustrated in FIG. 2 which shows a shifted set 332 of blocks, which is shifted compared to the current set 132 of blocks and which comprises the blocks 3 and 4 of the previous set 132 of blocks (indicated by reference numerals 203 and 201, respectively) and the blocks 1 and 2 of the current set 132 of blocks (indicated by reference numerals 204 and 205, respectively). As a matter of fact, the interpolated envelopes 136 determined based on the quantized current envelope 134 and based on the quantized previous envelope 135 may have an increased relevance for the blocks of the shifted set 332 of blocks, compared to the relevance for the blocks of the current set 132 of blocks.

Hence, the interpolated envelopes 136 shown in FIG. 3*b* may be used for flattening the blocks 131 of the shifted set 332 of blocks. This is shown by FIG. 3*b* in combination with FIG. 2. It can be seen that the interpolated envelope 341 of FIG. 3*b* may be applied to block 203 of FIG. 2, that the interpolated envelope 342 of FIG. 3*b* may be applied to block 201 of FIG. 2, that the interpolated envelope 343 of FIG. 3*b* may be applied to block 204 of FIG. 2, and that the interpolated envelope 344 of FIG. 3*b* (which in the illustrated example corresponds to the quantized current envelope 136) may be applied to block 205 of FIG. 2. As such, the set 132 of blocks for determining the quantized current envelope 134 may differ from the shifted set 332 of blocks for which the interpolated envelopes 136 are determined and to which the interpolated envelopes 136 are applied (for flattening purposes). In particular, the quantized current envelope 134 may be determined using a certain look-ahead with respect to the blocks 203, 201, 204, 205 of the shifted set 332 of blocks, which are to be flattened using the quantized current envelope 134. This is beneficial from a continuity point of view.

The interpolation of energy values 303 to determine interpolated envelopes 136 is illustrated in FIG. 3*b*. It can be seen that by interpolation between an energy value of the quantized previous envelope 135 to the corresponding energy value of the quantized current envelope 134 energy values of the interpolated envelopes 136 may be determined for the blocks 131 of the shifted set 332 of blocks. In particular, for each block 131 of the shifted set 332 an interpolated envelope 136 may be determined, thereby providing a plurality of interpolated envelopes 136 for the plurality of blocks 203, 201, 204, 205 of the shifted set 332 of blocks. The interpolated envelope 136 of a block 131 of transform coefficient (e.g. any of the blocks 203, 201, 204, 205 of the shifted set 332 of blocks) may be used to encode the block 131 of transform coefficients. It should be noted that the quantization indices 161 of the current envelope 133 are provided to a corresponding decoder within the bitstream. Consequently, the corresponding decoder may be configured to determine the plurality of interpolated envelopes 136 in an analog manner to the interpolation unit 104 of the encoder 100.

The framing unit 101, the envelope estimation unit 103, the envelope quantization unit 103, and the interpolation unit 104 operate on a set of blocks (i.e. the current set 132 of blocks and/or the shifted set 332 of blocks). On the other hand, the actual encoding of transform coefficient may be performed on a block-by-block basis. In the following, reference is made to the encoding of a current block 131 of transform coefficients, which may be any one of the plurality of block 131 of the shifted set 332 of blocks (or possibly the current set 132 of blocks in other implementations of the transform-based speech encoder 100).

The current interpolated envelope 136 for the current block 131 may provide an approximation of the spectral envelope of the transform coefficients of the current block 131. The encoder 100 may comprise a pre-flattening unit 105 and an envelope gain determination unit 106 which are configured to determine an adjusted envelope 139 for the current block 131, based on the current interpolated envelope 136 and based on the current block 131. In particular, an envelope gain for the current block 131 may be determined such that a variance of the flattened transform coefficients of the current block 131 is adjusted. X (k), k=1, . . . , K may be the transform coefficients of the current block 131 (with e.g. K=256), and E(k), k=1, . . . , K may be the mean spectral energy values 303 of current interpolated envelope 136 (with the energy values E(k) of a same frequency band 302 being equal). The envelope gain a may be determined such that the variance of the flattened transform coefficients $$\tilde{X}(k) = \frac{X(k)}{a \cdot \sqrt{E(k)}}$$

is adjusted. In particular, the envelope gain a may be determined such that the variance is one.

It should be noted that the envelope gain a may be determined for a sub-range of the complete frequency range of the current block 131 of transform coefficients. In other words, the envelope gain a may be determined only based on a subset of the frequency bins 301 and/or only based on a subset of the frequency bands 302. By way of example, the envelope gain a may be determined based on the frequency bins 301 greater than a start frequency bin 304 (the start frequency bin being greater than 0 or 1). As a consequence, the adjusted envelope 139 for the current block 131 may be determined by applying the envelope gain a only to the mean spectral energy values 303 of the current interpolated envelope 136 which are associated with frequency bins 301 lying above the start frequency bin 304. Hence, the adjusted envelope 139 for the current block 131 may correspond to the current interpolated envelope 136, for frequency bins 301 at and below the start frequency bin, and may correspond to the current interpolated envelope 136 offset by the envelope gain a, for frequency bins 301 above the start frequency bin. This is illustrated in FIG. 3*a* by the adjusted envelope 339 (shown in dashed lines).

The application of the envelope gain a 137 (which is also referred to as a level correction gain) to the current interpolated envelope 136 corresponds to an adjustment or an offset of the current interpolated envelope 136, thereby yielding an adjusted envelope 139, as illustrated by FIG. 3*a*. The envelope gain a 137 may be encoded as gain data 162 into the bitstream.

The encoder 100 may further comprise an envelope refinement unit 107 which is configured to determine the adjusted envelope 139 based on the envelope gain a 137 and based on the current interpolated envelope 136. The adjusted envelope 139 may be used for signal processing of the block 131 of transform coefficient. The envelope gain a 137 may be quantized to a higher resolution (e.g. in 1 dB steps) compared to the current interpolated envelope 136 (which may be quantized in 3 dB steps). As such, the adjusted envelope 139 may be quantized to the higher resolution of the envelope gain a 137 (e.g. in 1 dB steps).

Furthermore, the envelope refinement unit 107 may be configured to determine an allocation envelope 138. The allocation envelope 138 may correspond to a quantized version of the adjusted envelope 139 (e.g. quantized to 3 dB quantization levels). The allocation envelope 138 may be used for bit allocation purposes. In particular, the allocation envelope 138 may be used to determine—for a particular transform coefficient of the current block 131—a particular quantizer from a pre-determined set of quantizers, wherein the particular quantizer is to be used for quantizing the particular transform coefficient.

The encoder 100 comprises a flattening unit 108 configured to flatten the current block 131 using the adjusted envelope 139, thereby yielding the block 140 of flattened transform coefficients $\tilde{X}(k)$. The block 140 of flattened transform coefficients $\tilde{X}(k)$ may be encoded using a prediction loop within the transform domain. As such, the block 140 may be encoded using a subband predictor 117. The prediction loop comprises a difference unit 115 configured to determine a block 141 of prediction error coefficients $\Delta(k)$, based on the block 140 of flattened transform coefficients $\tilde{X}(k)$ and based on a block 150 of estimated transform coefficients $\hat{X}(k)$, e.g. $\Delta(k)=\tilde{X}(k)-\hat{X}(k)$. It should be noted that due to the fact that the block 140 comprises flattened transform coefficients, i.e. transform coefficients which have been normalized or flattened using the energy values 303 of the adjusted envelope 139, the block 150 of estimated transform coefficients also comprises estimates of flattened transform coefficients. In other words, the difference unit 115 operates in the so-called flattened domain. By consequence, the block 141 of prediction error coefficients $\Delta(k)$ is represented in the flattened domain.

The block 141 of prediction error coefficients $\Delta(k)$ may exhibit a variance which differs from one. The encoder 100 may comprise a rescaling unit 111 configured to rescale the prediction error coefficients $\Delta(k)$ to yield a block 142 of rescaled error coefficients. The rescaling unit 111 may make use of one or more pre-determined heuristic rules to perform the rescaling. As a result, the block 142 of rescaled error coefficients exhibits a variance which is (in average) closer to one (compared to the block 141 of prediction error coefficients). This may be beneficial to the subsequent quantization and encoding.

Figure 4:
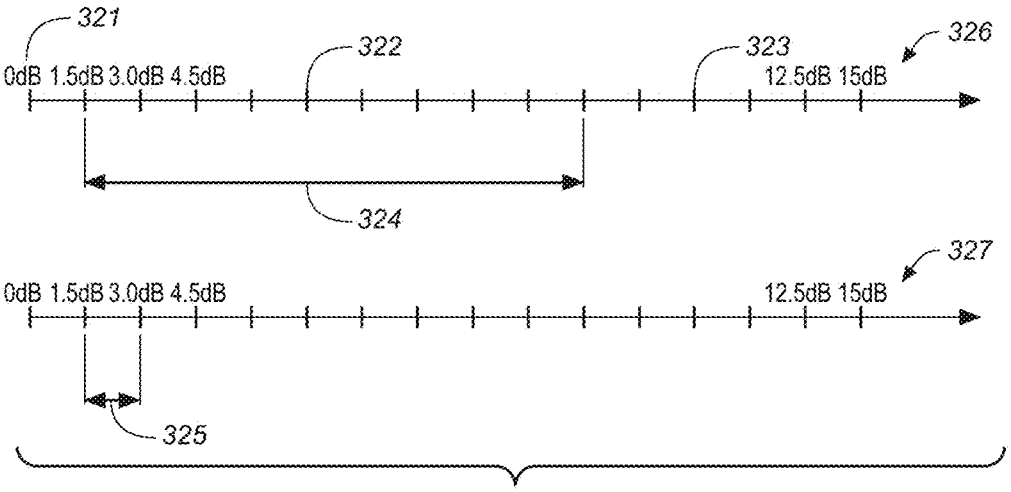

The encoder 100 comprises a coefficient quantization unit 112 configured to quantize the block 141 of prediction error coefficients or the block 142 of rescaled error coefficients. The coefficient quantization unit 112 may comprise or may make use of a set of pre-determined quantizers. The set of pre-determined quantizers may provide quantizers with different degrees of precision or different resolution. This is illustrated in FIG. 4 where different quantizers 321, 322, 323 are illustrated. The different quantizers may provide different levels of precision (indicated by the different dB values). A particular quantizer of the plurality of quantizers 321, 322, 323 may correspond to a particular value of the allocation envelope 138. As such, an energy value of the allocation envelope 138 may point to a corresponding quantizer of the plurality of quantizers. As such, the determination of an allocation envelope 138 may simplify the selection process of a quantizer to be used for a particular error coefficient. In other words, the allocation envelope 138 may simplify the bit allocation process.

The set of quantizers may comprise one or more quantizers 322 which make use of dithering for randomizing the quantization error. This is illustrated in FIG. 4 showing a first set 326 of pre-determined quantizers which comprises a subset 324 of dithered quantizers and a second set 327 pre-determined quantizers which comprises a subset 325 of dithered quantizers. As such, the coefficient quantization unit 112 may make use of different sets 326, 327 of pre-determined quantizers, wherein the set of pre-determined quantizers, which is to be used by the coefficient quantization unit 112 may depend on a control parameter 146 provided by the predictor 117 and/or determined based on other side information available at the encoder and at the corresponding decoder. In particular, the coefficient quantization unit 112 may be configured to select a set 326, 327 of pre-determined quantizers for quantizing the block 142 of rescaled error coefficient, based on the control parameter 146, wherein the control parameter 146 may depend on one or more predictor parameters provided by the predictor 117. The one or more predictor parameters may be indicative of the quality of the block 150 of estimated transform coefficients provided by the predictor 117.

The quantized error coefficients may be entropy encoded, using e.g. a Huffman code, thereby yielding coefficient data 163 to be included into the bitstream generated by the encoder 100.

In the following further details regarding the selection or determination of a set 326 of quantizers 321, 322, 323 are described. A set 326 of quantizers may correspond to an ordered collection 326 of quantizers. The ordered collection 326 of quantizers may comprise N quantizers, wherein each quantizer may correspond to a different distortion level. As such, the collection 326 of quantizers may provide N possible distortion levels. The quantizers of the collection 326 may be ordered according to decreasing distortion (or equivalently according to increasing SNR). Furthermore, the quantizers may be labeled by integer labels. By way of example, the quantizers may be labeled 0, 1, 2, etc., wherein an increasing integer label may indicate an increasing SNR.

The collection 326 of quantizers may be such that an SNR gap between two consecutive quantizers is at least approximately constant. For example, the SNR of the quantizer with a label "1" may be 1.5 dB, and the SNR of the quantizer with a label "2" may be 3.0 dB. Hence, the quantizers of the ordered collection 326 of quantizers may be such that by changing from a first quantizer to an adjacent second quantizer, the SNR (signal-to-noise ratio) is increased by a substantially constant value (e.g. 1.5 dB), for all pairs of first and second quantizers.

The collection 326 of quantizers may comprise

- a noise-filling quantizer 321 that may provide an SNR that is slightly lower than or equal 0 dB, which for the rate allocation process may be approximated as 0 dB;
- $N_{dith}$ quantizers 322 that may use subtractive dithering and that typically correspond to intermediate SNR levels (e.g. $N_{dith}>0$); and
- $N_{cq}$ classic quantizers 323 that do not use subtractive dithering and that typically correspond to relatively high SNR levels (e.g. $N_{cq}>0$). The un-dithered quantizers 323 may correspond to scalar quantizers.

The total number N of quantizers is given by $N=1+N_{dith}+N_{cq}$.

Figure 6A:
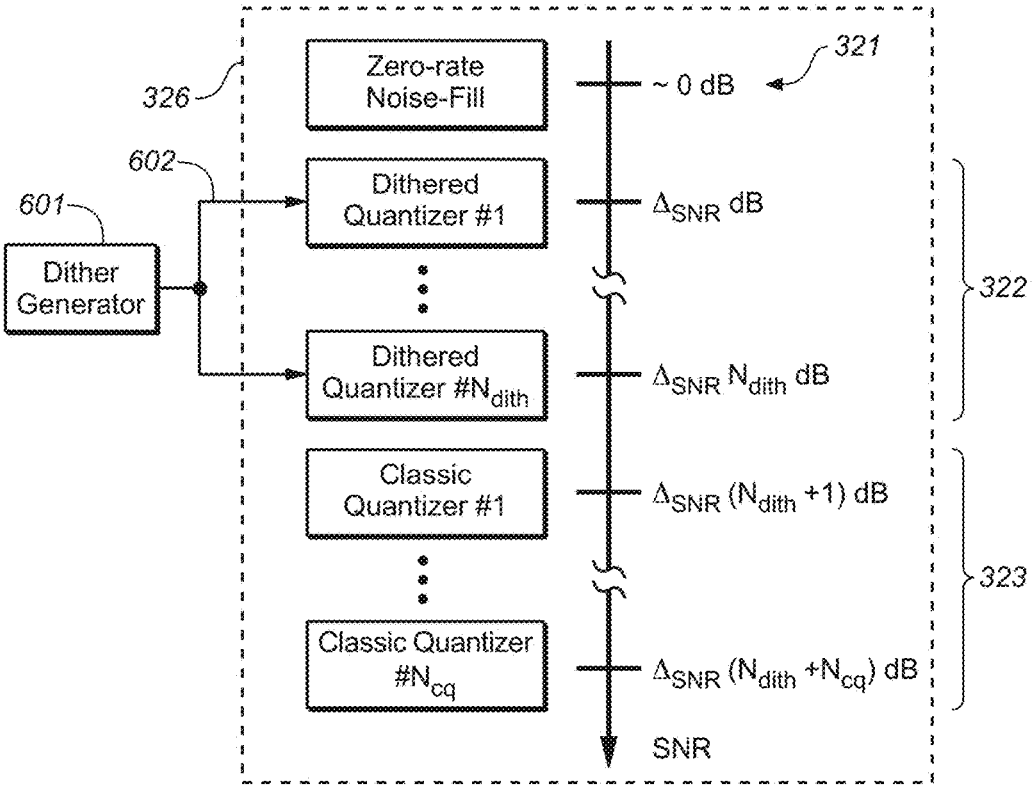

An example of a quantizer collection 326 is shown in FIG. 6*a*. The noise-filling quantizer 321 of the collection 326 of quantizers may be implemented, for example, using a random number generator that outputs a realization of a random variable according to a predefined statistical model. A possible implementation of such a random number generator may involve the usage of a fixed table with random samples of the predefined statistical model and possibly a subsequent renormalization. The random number generator which is used at the encoder 100 is in sync with the random number generator at the corresponding decoder. The synchronicity of the random number generators may be obtained by using the common seed to initialize the random number generators, and/or by resetting states of the number generators a fixed time instances. Alternatively, the generators may be implemented as look-up tables containing random data generated according to a prescribed statistical model. In particular, if the predictor is active, it may be ensured that the output of the noise-filling quantizer 321 is the same at the encoder 100 and at the corresponding decoder.

In addition, the collection 326 of quantizers may comprise one or more dithered quantizers 322. The one or more dithered quantizers may be generated using a realization of a pseudo-number dither signal 602 as shown in FIG. 6*a*. The pseudo-number dither signal 602 may correspond to a block 602 of pseudo-random dither values. The block 602 of dither numbers may have the same dimensionality as the dimensionality of the block 142 of rescaled error coefficients, which is to be quantized. The dither signal 602 (or the block 602 of dither values) may be generated using a dither generator 601. In particular, the dither signal 602 may be generated using a look-up table containing uniformly distributed random samples.

Figure 6B:
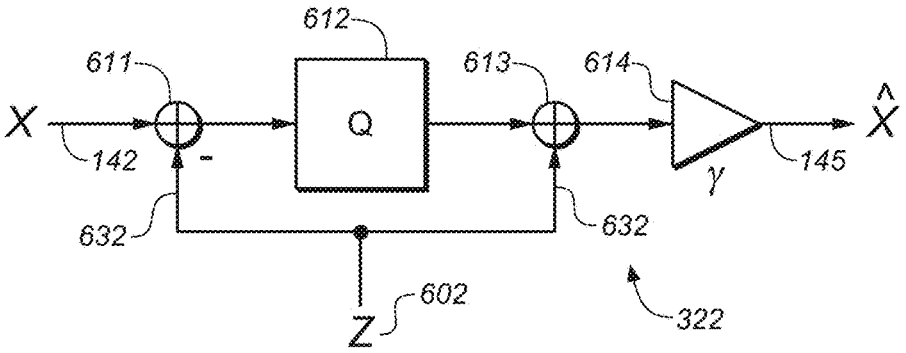

As will be shown in the context of FIG. 6*b*, individual dither values 632 of the block 602 of dither values are used to apply a dither to a corresponding coefficient which is to be quantized (e.g. to a corresponding rescaled error coefficient of the block 142 of rescaled error coefficients). The block 142 of rescaled error coefficients may comprise a total of K rescaled error coefficients. In a similar manner, the block 602 of dither values may comprise K dither values 632. The $k^{th}$ dither value 632, with k=1, . . . , K, of the block 602 of dither values may be applied to the $k^{th}$ rescaled error coefficient of the block 142 of rescaled error coefficients.

As indicated above, the block 602 of dither values may have the same dimension as the block 142 of rescaled error coefficients, which are to be quantized. This is beneficial, as this allows using a single block 602 of dither values for all the dithered quantizers 322 of a collection 326 of quantizers. In other words, in order to quantize and encode a given block 142 of rescaled error coefficients, the pseudo-random dither 602 may be generated only once for all admissible collections 326, 327 of quantizers and for all possible allocations for the distortion. This facilitates achieving synchronicity between the encoder 100 and the corresponding decoder, as the use of the single dither signal 602 does not need to be explicitly signaled to the corresponding decoder. In particular, the encoder 100 and the corresponding decoder may make use of the same dither generator 601 which is configured to generate the same block 602 of dither values for the block 142 of rescaled error coefficients.

The composition of the collection 326 of quantizers is preferably based on psycho-acoustical considerations. Low rate transform coding may lead to spectral artifacts including spectral holes and band-limitation that are triggered by the nature of the reverse-water filling process that takes place in conventional quantization schemes which are applied to transform coefficients. The audibility of the spectral holes can be reduced by injecting noise into those frequency bands 302 which happened to be below water level for a short time period and which were thus allocated with a zero bit-rate.

Coarse quantization of coefficients in the frequency-domain may lead to specific coding artifacts (e.g., deep spectral holes, so-called "birdies") that are generated in a situation when coefficients of a particular frequency band 302 are quantized to zero (in the case of deep spectral holes) in one frame and quantized to non-zero values in the next frame and the when the whole process repeats for tens of milliseconds. The coarser the quantizers are, the more prone they are to producing such a behavior. This technical problem may be addressed by applying a noise-fill to quantization indices used for signal reconstruction at 0-level (as outlined e.g. in U.S. Pat. No. 7,447,631). The solution describe in U.S. Pat. No. 7,447,631 facilitates a reduction of the artifacts as it reduces the audibility of the deep spectral holes associated with 0-level quantization, however, artifacts associated with the shallower spectral holes remain. One could apply the noise-fill method also to the quantization indices of coarse quantizer. However, this would significantly degrade the MSE-performance of these quantizers. It has been observed by the inventors that this drawback can be addressed by the usage of dithered quantizers. In the present document, it is proposed to use quantizers 322 with a subtractive dither for low SNR levels, in order to address the MSE performance issue. Furthermore, the use of quantizers 322 with subtractive dither facilitates noise-filling properties for all the reconstruction levels. Since a dithered quantizer 322 is analytically tractable at any bit-rate, it is possible to reduce (e.g. minimize) the performance loss due to dithering by deriving post-gains 614, which are useful at high-distortion levels (i.e. low rates).

In general, it is possible to achieve an arbitrarily low bit-rate with a dithered quantizer 322. For example, in the scalar case one may choose to use a very large quantization step-size. Nevertheless, the zero bit-rate operation is not feasible in practice, because it would impose demanding requirements on the numeric precision needed to enable operation of the quantizer with a variable length coder. This provides the motivation to apply a generic noise fill quantizer 321 to the 0 dB SNR distortion level, rather than to apply a dithered quantizer 322. The proposed collection 326 of quantizers is designed such that the dithered quantizers 322 are used for distortion levels that are associated with relatively small step sizes, such that the variable length coding can be implemented without having to address issues related to maintaining the numerical precision.

For the case of scalar quantization, the quantizers 322 with subtractive dithering may be implemented using post-gains that provide near optimal MSE performance. An example of a subtractively dithered scalar quantizer 322 is shown in FIG. 6*b*. The dithered quantizer 322 comprises a uniform scalar quantizer Q 612 that is used within a subtractive dithering structure. The subtractive dithering structure comprises a dither subtraction unit 611 which is configured to subtract a dither value 632 (from the block 602 of dither values) from a corresponding error coefficient (from the block 142 of rescaled error coefficients). Furthermore, the subtractive dithering structure comprises a corresponding addition unit 613 which is configured to add the dither value 632 (from the block 602 of dither values) to the corresponding scalar quantized error coefficient. In the illustrated example, the dither subtraction unit 611 is placed upstream of the scalar quantizer Q 612 and the dither addition unit 613 is placed downstream of the scalar quantizer Q 612. The dither values 632 from the block 602 of dither values may taken on values from the interval [−0.5, 0.5) or [0,1) times the step size of the scalar quantizer 612. It should be noted that in an alternative implementation of the dithered quantizer 322, the dither subtraction unit 611 and the dither addition unit 613 may be exchanged with one another.

The subtractive dithering structure may be followed by a scaling unit 614 which is configured to rescale the quantized error coefficients by a quantizer post-gain γ. Subsequent to scaling of the quantized error coefficients, the block 145 of quantized error coefficients is obtained. It should be noted that the input X to the dithered quantizer 322 typically corresponds to the coefficients of the block 142 of rescaled error coefficients which fall into the particular frequency band which is to be quantized using the dithered quantizer 322. In a similar manner, the output of the dithered quantizer 322 typically corresponds to the quantized coefficients of the block 145 of quantized error coefficients which fall into the particular frequency band.

It may be assumed that the input X to the dithered quantizer 322 is zero mean and that the variance $\sigma_X^2=E\{X^2\}$ of the input X is known. (For example, the variance of the signal may be determined from the envelope of the signal.) Furthermore, it may be assumed that a pseudo-random dither block Z 602 comprising dither values 632 is available to the encoder 100 and to the corresponding decoder. Furthermore, it may be assumed that the dither values 632 are independent from the input X. Various different dithers 602 may be used, but it is assume in the following that the dither Z 602 is uniformly distributed between 0 and Δ, which may be denoted by U (0,Δ). In practice, any dither that fulfills the so-called Schuchman conditions may be used (e.g. a dither 602 which is uniformly distributed between [−0.5, 0.5) times the step size Δ of the scalar quantizer 612).

The quantizer Q 612 may be a lattice and the extent of its Voronoi cell may be Δ. In this case, the dither signal would have a uniform distribution over the extent of the Voronoi cell of the lattice that is used.

The quantizer post-gain γ may be derived given the variance of the signal and the quantization step size, since the dither quantizer is analytically tractable for any step size (i.e., bit-rate). In particular, the post-gain may be derived to improve the MSE performance of a quantizer with a subtractive dither. The post-gain may be given by:

$$\gamma = \frac{\sigma_X^2}{\sigma_X^2 + \frac{\Delta^2}{12}}.$$

Even though by application of the post-gain γ, the MSE performance of the dithered quantizer 322 may be improved, a dithered quantizer 322 typically has a lower MSE performance than a quantizer with no dithering (although this performance loss vanishes as the bit-rate increases). Consequently, in general, dithered quantizers are more noisy than their un-dithered versions. Therefore, it may be desirable to use dithered quantizers 322 only when the use of dithered quantizers 322 is justified by the perceptually beneficial noise-fill property of dithered quantizers 322.

Hence, a collection 326 of quantizers comprising three types of quantizers may be provided. The ordered quantizer collection 326 may comprise a single noise-fill quantizer 321, one or more quantizers 322 with subtractive dithering and one or more classic (un-dithered) quantizers 323. The consecutive quantizers 321, 322, 323 may provide incremental improvements to the SNR. The incremental improvements between a pair of adjacent quantizers of the ordered collection 326 of quantizers may be substantially constant for some or all of the pairs of adjacent quantizers.

A particular collection 326 of quantizers may be defined by the number of dithered quantizers 322 and by the number of un-dithered quantizers 323 comprised within the particular collection 326. Furthermore, the particular collection 326 of quantizers may be defined by a particular realization of the dither signal 602. The collection 326 may be designed in order to provide perceptually efficient quantization of the transform coefficient rendering: zero rate noise-fill (yielding SNR slightly lower or equal to 0 dB); noise-fill by subtractive dithering at intermediate distortion level (intermediate SNR); and lack of the noise-fill at low distortion levels (high SNR). The collection 326 provides a set of admissible quantizers that may be selected during a rate-allocation process. An application of a particular quantizer from the collection 326 of quantizers to the coefficients of a particular frequency band 302 is determined during the rate-allocation process. It is typically not known a priori, which quantizer will be used to quantize the coefficients of a particular frequency band 302. However, it is typically known a priori, what the composition of the collection 326 of the quantizers is.

Figure 6C:
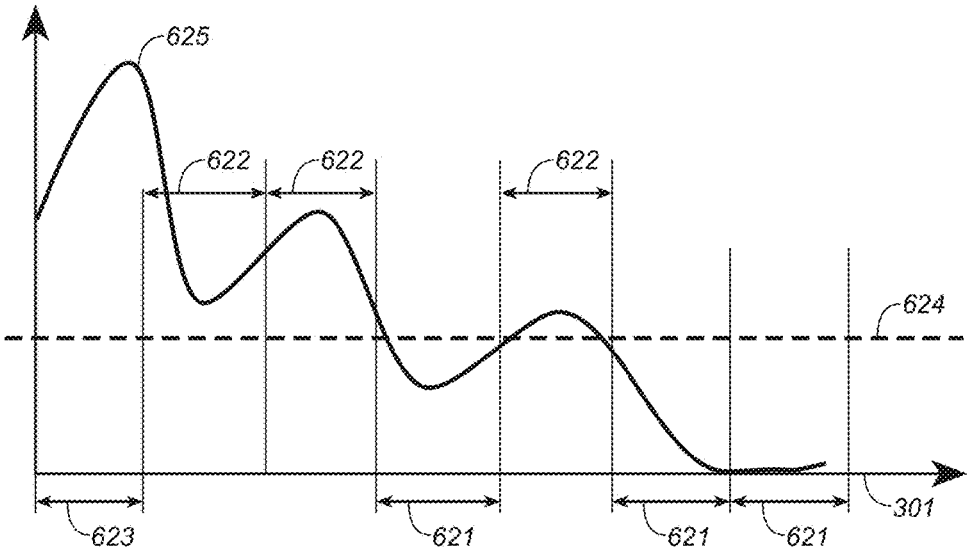

The aspect of using different types of quantizers for different frequency bands 302 of a block 142 of error coefficients is illustrated in FIG. 6*c*, where an exemplary outcome of the rate allocation process is shown. In this example, it is assumed that the rate allocation follows the so-called reverse water-filling principle. FIG. 6*c* illustrates the spectrum 625 of an input signal (or the envelope of the to-be-quantized block of coefficients). It can be seen that the frequency band 623 has relatively high spectral energy and is quantized using a classical quantizer 323 which provides relatively low distortion levels. The frequency bands 622 exhibit a spectral energy above the water level 624. The coefficients in these frequency bands 622 may be quantized using the dithered quantizers 322 which provide intermediate distortion levels. The frequency bands 621 exhibit a spectral energy below the water level 624. The coefficients in these frequency bands 621 may be quantized using zero-rate noise fill. The different quantizers used to quantize the particular block of coefficients (represented by the spectrum 625) may be part of a particular collection 326 of quantizers, which has been determined for the particular block of coefficients.

Hence, the three different types of quantizers 321, 322, 323 may be applied selectively (for example selectively with regards to frequency). The decision on the application of a particular type of quantizer may be determined in the context of a rate allocation procedure, which is described below. The rate allocation procedure may make use of a perceptual criterion that can be derived from the RMS envelope of the input signal (or, for example, from the power spectral density of the signal). The type of the quantizer to be applied in a particular frequency band 302 does not need to be signaled explicitly to the corresponding decoder. The need for signaling the selected type of quantizer is eliminated, since the corresponding decoder is able to determine the particular set 326 of quantizers that was used to quantize a block of the input signal from the underlying perceptual criterion (e.g. the allocation envelope 138), from the predetermined composition of the collection of the quantizers (e.g. a pre-determined set of different collections of quantizers), and from a single global rate allocation parameter (also referred to as an offset parameter).

The determination at the decoder of the collection 326 of quantizers, which has been used by the encoder 100 is facilitated by designing the collection 326 of the quantizers so that the quantizers are ordered according to their distortion (e.g. SNR). Each quantizer of the collection 326 may decrease the distortion (may refine the SNR) of the preceding quantizer by a constant value. Furthermore, a particular collection 326 of quantizers may be associated with a single realization of a pseudo-random dither signal 602, during the entire rate allocation process. As a result of this, the outcome of the rate allocation procedure does not affect the realization of the dither signal 602. This is beneficial for ensuring a convergence of the rate allocation procedure. Furthermore, this enables the decoder to perform decoding if the decoder knows the single realization of the dither signal 602. The decoder may be made aware of the realization of the dither signal 602 by using the same pseudo-random dither generator 601 at the encoder 100 and at the corresponding decoder.

As indicated above, the encoder 100 may be configured to perform a bit allocation process. For this purpose, the encoder 100 may comprise bit allocation units 109, 110. The bit allocation unit 109 may be configured to determine the total number of bits 143 which are available for encoding the current block 142 of rescaled error coefficients. The total number of bits 143 may be determined based on the allocation envelope 138. The bit allocation unit 110 may be configured to provide a relative allocation of bits to the different rescaled error coefficients, depending on the corresponding energy value in the allocation envelope 138.

The bit allocation process may make use of an iterative allocation procedure. In the course of the allocation procedure, the allocation envelope 138 may be offset using an offset parameter, thereby selecting quantizers with increased/decreased resolution. As such, the offset parameter may be used to refine or to coarsen the overall quantization. The offset parameter may be determined such that the coefficient data 163, which is obtained using the quantizers given by the offset parameter and the allocation envelope 138, comprises a number of bits which corresponds to (or does not exceed) the total number of bits 143 assigned to the current block 131. The offset parameter which has been used by the encoder 100 for encoding the current block 131 is included as coefficient data 163 into the bitstream. As a consequence, the corresponding decoder is enabled to determine the quantizers which have been used by the coefficient quantization unit 112 to quantize the block 142 of rescaled error coefficients.

As such, the rate allocation process may be performed at the encoder 100, where it aims at distributing the available bits 143 according to a perceptual model. The perceptual model may depend on the allocation envelope 138 derived from the block 131 of transform coefficients. The rate allocation algorithm distributes the available bits 143 among the different types of quantizers, i.e. the zero-rate noise-fill 321, the one or more dithered quantizers 322 and the one or more classic un-dithered quantizers 323. The final decision on the type of quantizer to be used to quantize the coefficients of a particular frequency band 302 of the spectrum may depend on the perceptual signal model, on the realization of the pseudo-random dither and on the bit-rate constraint.

At the corresponding decoder, the bit allocation (indicated by the allocation envelope 138 and by the offset parameter) may be used to determine the probabilities of the quantization indices in order to facilitate the lossless decoding. A method of computation of probabilities of quantization indices may be used, which employs the usage of a realization of the full-band pseudo random dither 602, the perceptual model parameterized by the signal envelope 138 and the rate allocation parameter (i.e. the offset parameter). Using the allocation envelope 138, the offset parameter and the knowledge regarding the block 602 of dither values, the composition of the collection 326 of quantizers at the decoder may be in sync with the collection 326 used at the encoder 100.

As outlined above, the bit-rate constraint may be specified in terms of a maximum allowed number of bits per frame 143. This applies e.g. to quantization indices which are subsequently entropy encoded using e.g. a Huffman code. In particular, this applies in coding scenarios where the bitstream is generated in a sequential fashion, where a single parameter is quantized at a time, and where the corresponding quantization index is converted to a binary codeword, which is appended to the bitstream.

If arithmetic coding (or range coding) is in use, the principle is different. In the context of arithmetic coding, typically a single codeword is assigned to a long sequence of quantization indices. It is typically not possible to associate exactly a particular portion of the bitstream with a particular parameter. In particular, in the context of arithmetic coding, the number of bits that is required to encode a random realization of a signal is typically unknown. This is the case even if the statistical model of the signal is known.

In order to address the above mentioned technical problem, it is proposed to make the arithmetic encoder a part of the rate allocation algorithm. During the rate allocation process the encoder attempts to quantize and encode a set of coefficients of one or more frequency bands 302. For every such attempt, it is possible to observe the change of the state of the arithmetic encoder and to compute the number of positions to advance in the bitstream (instead of computing a number of bits). If a maximum bit-rate constraint is set, this maximum bit-rate constraint may be used in the rate allocation procedure. The cost of the termination bits of the arithmetic code may be included in the cost of the last coded parameter and, in general, the cost of the termination bits will vary depending on the state of the arithmetic coder. Nevertheless, once the termination cost is available, it is possible to determine the number of bits needed to encode the quantization indices corresponding to the set of coefficients of the one or more frequency bands 302.

It should be noted that in the context of arithmetic encoding, a single realization of the dither 602 may be used for the whole rate allocation process (of a particular block 142 of coefficients). As outlined above, the arithmetic encoder may be used to estimate the bit-rate cost of a particular quantizer selection within the rate allocation procedure. The change of the state of the arithmetic encoder may be observed and the state change may be used to compute a number of bits needed to perform the quantization. Furthermore, the process of termination of the arithmetic code may be used within in the rate allocation process.

As indicated above, the quantization indices may be encoded using an arithmetic code or an entropy code. If the quantization indices are entropy encoded, the probability distribution of the quantization indices may be taken into account, in order to assign codewords of varying length to individual or to groups of quantization indices. The use of dithering may have an impact on the probability distribution of the quantization indices. In particular, the particular realization of a dither signal 602 may have an impact on the probability distribution of the quantization indices. Due to the virtually unlimited number of realizations of the dither signal 602, in the general case, the codeword probabilities are not known a priori and it is not possible to use Huffman coding.

It has been observed by the inventors that it is possible to reduce the number of possible dither realizations to a relatively small and manageable set of realizations of the dither signal 602. By way of example, for each frequency band 302 a limited set of dither values may be provided. For this purpose, the encoder 100 (as well as the corresponding decoder) may comprise a discrete dither generator 801 configured to generate the dither signal 602 by selecting one of M pre-determined dither realizations (see FIG. 8). By way of example, M different pre-determined dither realizations may be used for every frequency band 302. The number M of pre-determined dither realizations may be M<5 (e.g. M=4 or M=3)

Due to the limited number M of dither realizations, it is possible to train a (possibly multidimensional) Huffman codebook for each dither realization, yielding a collection 803 of M codebooks. The encoder 100 may comprise a codebook selection unit 802 which is configured to select one of the collection 803 of M pre-determined codebooks, based on the selected dither realization. By doing this, it is ensured that the entropy encoding is in sync with the dither generation. The selected codebook 811 may be used to encode individual or groups of quantization indices which have been quantized using the selected dither realization. As a consequence, the performance of entropy encoding can be improved, when using dithered quantizers.

Figure 8:
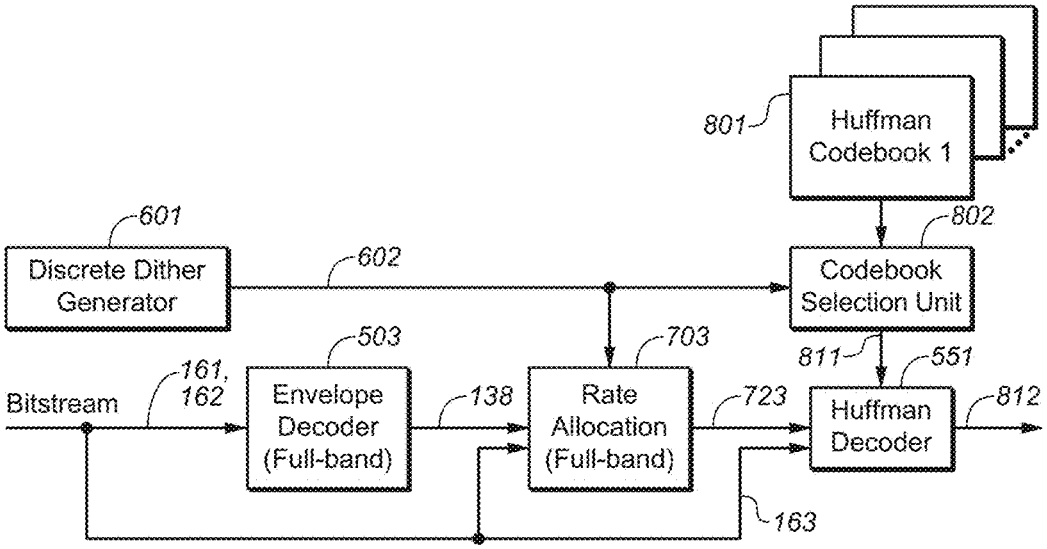
FIG. 8 shows a block diagram of an example scheme for decoding entropy encoded quantization indices which have been determined using a dithered quantizer.

The collection 803 of pre-determined codebooks and the discrete dither generator 801 may also be used at the corresponding decoder (as illustrated in FIG. 8). The decoding is feasible if a pseudo-random dither is used and if the decoder remains in sync with the encoder 100. In this case, the discrete dither generator 801 at the decoder generates the dither signal 602, and the particular dither realization is uniquely associated with a particular Huffman codebook 811 from the collection 803 of codebooks. Given the psychoacoustic model (for instance, represented by the allocation envelope 138 and the rate allocation parameter) and the selected codebook 811, the decoder is able to perform decoding using the Huffman decoder 551 to yield the decoded quantization indices 812.

As such, a relatively small set 803 of Huffman codebooks may be used instead of arithmetic coding. The use of a particular codebook 811 from the set 813 of Huffman codebooks may depend on a pre-determined realization of the dither signal 602. At the same time, a limited set of admissible dither values forming M pre-determined dither realizations may be used. The rate allocation process may then involve the use of un-dithered quantizers, of dithered quantizers and of Huffman coding.

As a result of quantization of the rescaled error coefficients, a block 145 of quantized error coefficients is obtained. The block 145 of quantized error coefficients corresponds to the block of error coefficients which are available at the corresponding decoder. Consequently, the block 145 of quantized error coefficients may be used for determining a block 150 of estimated transform coefficients. The encoder 100 may comprise an inverse rescaling unit 113 configured to perform the inverse of the rescaling operations performed by the rescaling unit 113, thereby yielding a block 147 of scaled quantized error coefficients. An addition unit 116 may be used to determine a block 148 of reconstructed flattened coefficients, by adding the block 150 of estimated transform coefficients to the block 147 of scaled quantized error coefficients. Furthermore, an inverse flattening unit 114 may be used to apply the adjusted envelope 139 to the block 148 of reconstructed flattened coefficients, thereby yielding a block 149 of reconstructed coefficients. The block 149 of reconstructed coefficients corresponds to the version of the block 131 of transform coefficients which is available at the corresponding decode. By consequence, the block 149 of reconstructed coefficients may be used in the predictor 117 to determine the block 150 of estimated coefficients.

The block 149 of reconstructed coefficients is represented in the un-flattened domain, i.e. the block 149 of reconstructed coefficients is also representative of the spectral envelope of the current block 131. As outlined below, this may be beneficial for the performance of the predictor 117.

The predictor 117 may be configured to estimate the block 150 of estimated transform coefficients based on one or more previous blocks 149 of reconstructed coefficients. In particular, the predictor 117 may be configured to determine one or more predictor parameters such that a pre-determined prediction error criterion is reduced (e.g. minimized). By way of example, the one or more predictor parameters may be determined such that an energy, or a perceptually weighted energy, of the block 141 of prediction error coefficients is reduced (e.g. minimized). The one or more predictor parameters may be included as predictor data 164 into the bitstream generated by the encoder 100.

The predictor 117 may make use of a signal model, as described in the patent application U.S. Pat. No. 6,175,0052 and the patent applications which claim priority thereof, the content of which is incorporated by reference. The one or more predictor parameters may correspond to one or more model parameters of the signal model.

Figure 1B:
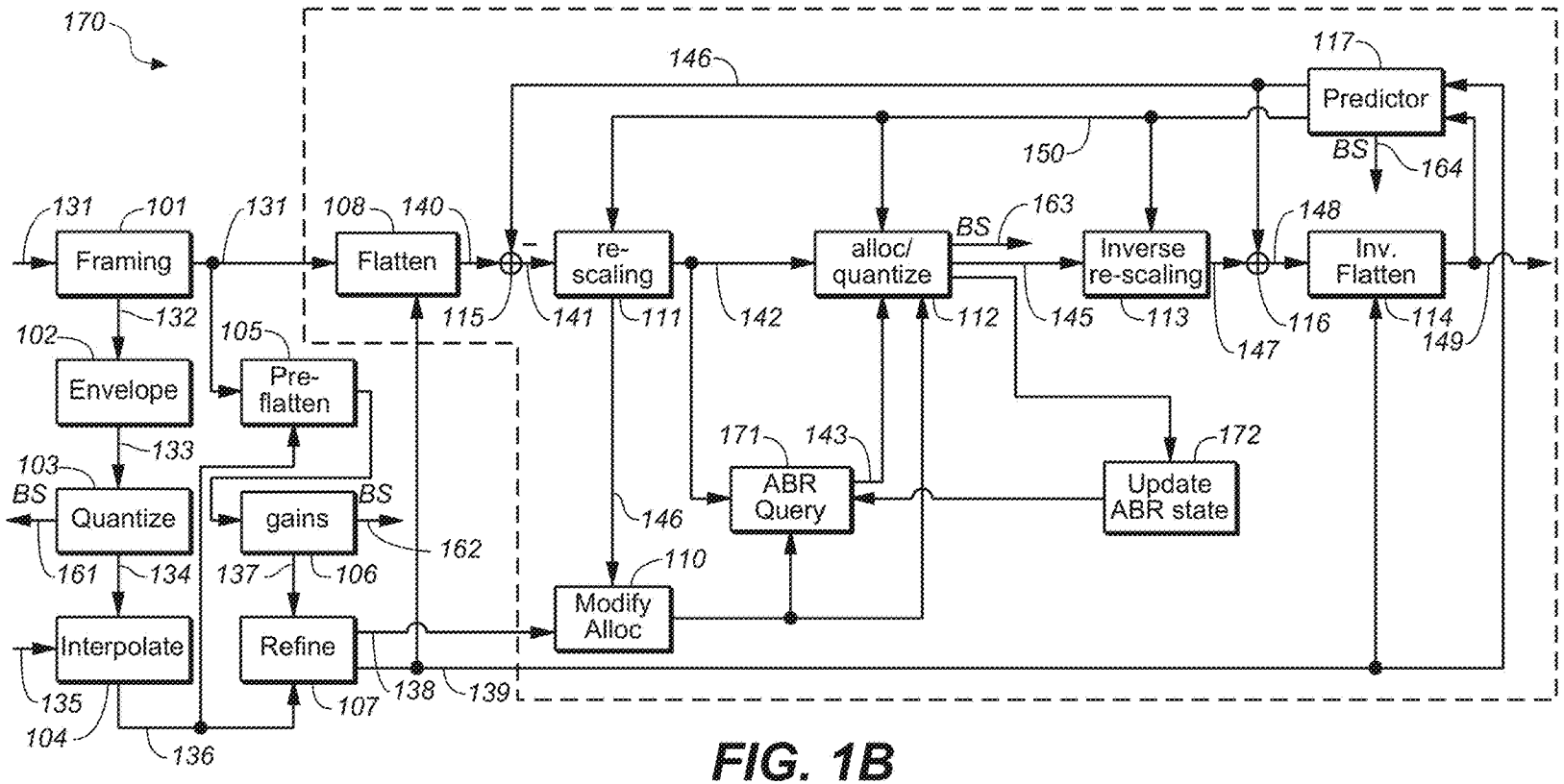

FIG. 1*b* shows a block diagram of a further example transform-based speech encoder 170. The transform-based speech encoder 170 of FIG. 1*b* comprises many of the components of the encoder 100 of FIG. 1*a*. However, the transform-based speech encoder 170 of FIG. 1*b* is configured to generate a bitstream having a variable bit-rate. For this purpose, the encoder 170 comprises an Average Bit Rate (ABR) state unit 172 configured to keep track of the bit-rate which has been used up by the bitstream for preceding blocks 131. The bit allocation unit 171 uses this information for determining the total number of bits 143 which is available for encoding the current block 131 of transform coefficients.

Overall, the transform-based speech encoders 100, 170 are configured to generate a bitstream which is indicative of or which comprises

- envelope data 161 indicative of a quantized current envelope 134. The quantized current envelope 134 is used to describe the envelope of the blocks of a current set 132 or a shifted set 332 of blocks of transform coefficients.
- gain data 162 indicative of a level correction gain a for adjusting the interpolated envelope 136 of a current block 131 of transform coefficients. Typically a different gain a is provided for each block 131 of the current set 132 or the shifted set 332 of blocks.
- coefficient data 163 indicative of the block 141 of prediction error coefficients for the current block 131. In particular, the coefficient data 163 is indicative of the block 145 of quantized error coefficients. Furthermore, the coefficient data 163 may be indicative of an offset parameter which may be used to determine the quantizers for performing inverse quantization at the decoder.
- predictor data 164 indicative of one or more predictor coefficients to be used to determine a block 150 of estimated coefficients from previous blocks 149 of reconstructed coefficients.

Figure 5A:
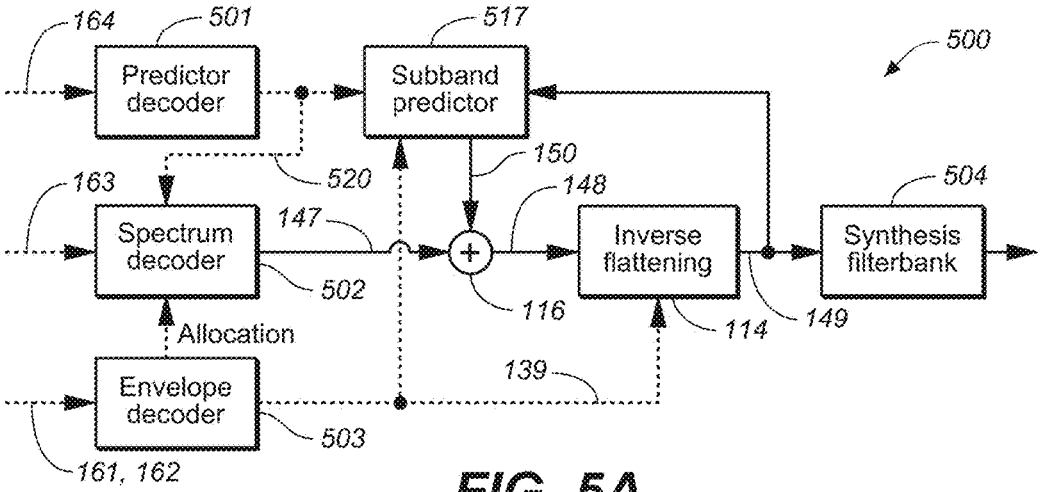
Figure 5B:
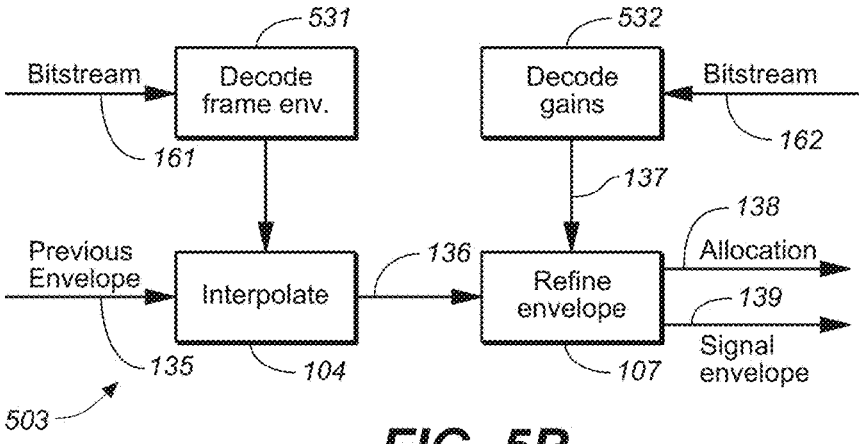
Figure 5C:
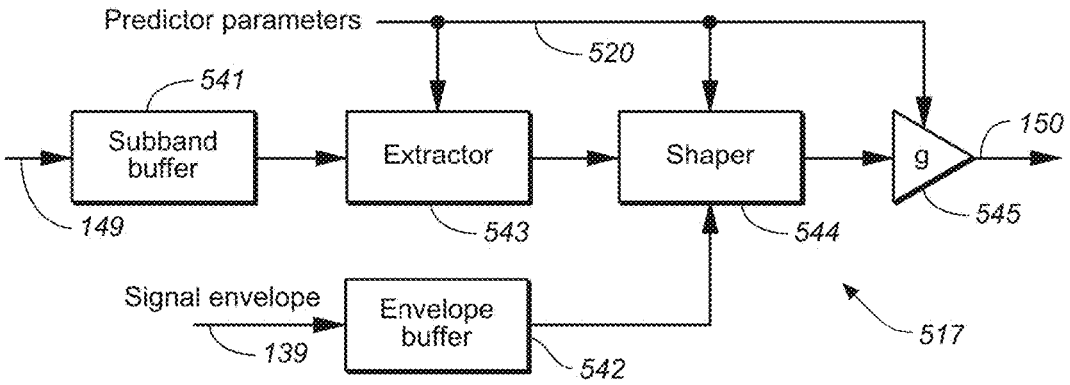

In the following, a corresponding transform-based speech decoder 500 is described in the context of FIGS. 5*a* to 5*d*. FIG. 5*a* shows a block diagram of an example transform-based speech decoder 500. The block diagram shows a synthesis filterbank 504 (also referred to as inverse transform unit) which is used to convert a block 149 of reconstructed coefficients from the transform domain into the time domain, thereby yielding samples of the decoded audio signal. The synthesis filterbank 504 may make use of an inverse MDCT with a pre-determined stride (e.g. a stride of approximately 5 ms or 256 samples).

The main loop of the decoder 500 operates in units of this stride. Each step produces a transform domain vector (also referred to as a block) having a length or dimension which corresponds to a pre-determined bandwidth setting of the system. Upon zero-padding up to the transform size of the synthesis filterbank 504, the transform domain vector will be used to synthesize a time domain signal update of a pre-determined length (e.g. 5 ms) to the overlap/add process of the synthesis filterbank 504.

As indicated above, generic transform-based audio codecs typically employ frames with sequences of short blocks in the 5 ms range for transient handling. As such, generic transform-based audio codecs provide the necessary transforms and window switching tools for a seamless coexistence of short and long blocks. A voice spectral frontend defined by omitting the synthesis filterbank 504 of FIG. 5*a* may therefore be conveniently integrated into the general purpose transform-based audio codec, without the need to introduce additional switching tools. In other words, the transform-based speech decoder 500 of FIG. 5*a* may be conveniently combined with a generic transform-based audio decoder. In particular, the transform-based speech decoder 500 of FIG. 5*a* may make use of the synthesis filterbank 504 provided by the generic transform-based audio decoder (e.g. the AAC or HE-AAC decoder).

From the incoming bitstream (in particular from the envelope data 161 and from the gain data 162 comprised within the bitstream), a signal envelope may be determined by an envelope decoder 503. In particular, the envelope decoder 503 may be configured to determine the adjusted envelope 139 based on the envelope data 161 and the gain data 162). As such, the envelope decoder 503 may perform tasks similar to the interpolation unit 104 and the envelope refinement unit 107 of the encoder 100, 170. As outlined above, the adjusted envelope 109 represents a model of the signal variance in a set of predefined frequency bands 302.

Furthermore, the decoder 500 comprises an inverse flattening unit 114 which is configured to apply the adjusted envelope 139 to a flattened domain vector, whose entries may be nominally of variance one. The flattened domain vector corresponds to the block 148 of reconstructed flattened coefficients described in the context of the encoder 100, 170. At the output of the inverse flattening unit 114, the block 149 of reconstructed coefficients is obtained. The block 149 of reconstructed coefficients is provided to the synthesis filterbank 504 (for generating the decoded audio signal) and to the subband predictor 517.

The subband predictor 517 operates in a similar manner to the predictor 117 of the encoder 100, 170. In particular, the subband predictor 517 is configured to determine a block 150 of estimated transform coefficients (in the flattened domain) based on one or more previous blocks 149 of reconstructed coefficients (using the one or more predictor parameters signaled within the bitstream). In other words, the subband predictor 517 is configured to output a predicted flattened domain vector from a buffer of previously decoded output vectors and signal envelopes, based on the predictor parameters such as a predictor lag and a predictor gain. The decoder 500 comprises a predictor decoder 501 configured to decode the predictor data 164 to determine the one or more predictor parameters.

The decoder 500 further comprises a spectrum decoder 502 which is configured to furnish an additive correction to the predicted flattened domain vector, based on typically the largest part of the bitstream (i.e. based on the coefficient data 163). The spectrum decoding process is controlled mainly by an allocation vector, which is derived from the envelope and a transmitted allocation control parameter (also referred to as the offset parameter). As illustrated in FIG. 5*a*, there may be a direct dependence of the spectrum decoder 502 on the predictor parameters 520. As such, the spectrum decoder 502 may be configured to determine the block 147 of scaled quantized error coefficients based on the received coefficient data 163. As outlined in the context of the encoder 100, 170, the quantizers 321, 322, 323 used to quantize the block 142 of rescaled error coefficients typically depends on the allocation envelope 138 (which can be derived from the adjusted envelope 139) and on the offset parameter. Furthermore, the quantizers 321, 322, 323 may depend on a control parameter 146 provided by the predictor 117. The control parameter 146 may be derived by the decoder 500 using the predictor parameters 520 (in an analog manner to the encoder 100, 170).

As indicated above, the received bitstream comprises envelope data 161 and gain data 162 which may be used to determine the adjusted envelope 139. In particular, unit 531 of the envelope decoder 503 may be configured to determine the quantized current envelope 134 from the envelope data 161. By way of example, the quantized current envelope 134 may have a 3 dB resolution in predefined frequency bands 302 (as indicated in FIG. 3*a*). The quantized current envelope 134 may be updated for every set 132, 332 of blocks (e.g. every four coding units, i.e. blocks, or every 20 ms), in particular for every shifted set 332 of blocks. The frequency bands 302 of the quantized current envelope 134 may comprise an increasing number of frequency bins 301 as a function of frequency, in order to adapt to the properties of human hearing.

The quantized current envelope 134 may be interpolated linearly from a quantized previous envelope 135 into interpolated envelopes 136 for each block 131 of the shifted set 332 of blocks (or possibly, of the current set 132 of blocks). The interpolated envelopes 136 may be determined in the quantized 3 dB domain. This means that the interpolated energy values 303 may be rounded to the closest 3 dB level. An example interpolated envelope 136 is illustrated by the dotted graph of FIG. 3*a*. For each quantized current envelope 134, four level correction gains a 137 (also referred to as envelope gains) are provided as gain data 162. The gain decoding unit 532 may be configured to determine the level correction gains a 137 from the gain data 162. The level correction gains may be quantized in 1 dB steps. Each level correction gain is applied to the corresponding interpolated envelope 136 in order to provide the adjusted envelopes 139 for the different blocks 131. Due to the increased resolution of the level correction gains 137, the adjusted envelope 139 may have an increased resolution (e.g. a 1 dB resolution).

FIG. 3*b* shows an example linear or geometric interpolation between the quantized previous envelope 135 and the quantized current envelope 134. The envelopes 135, 134 may be separated into a mean level part and a shape part of the logarithmic spectrum. These parts may be interpolated with independent strategies such as a linear, a geometrical, or a harmonic (parallel resistors) strategy. As such, different interpolation schemes may be used to determine the interpolated envelopes 136. The interpolation scheme used by the decoder 500 typically corresponds to the interpolation scheme used by the encoder 100, 170.

The envelope refinement unit 107 of the envelope decoder 503 may be configured to determine an allocation envelope 138 from the adjusted envelope 139 by quantizing the adjusted envelope 139 (e.g. into 3 dB steps). The allocation envelope 138 may be used in conjunction with the allocation control parameter or offset parameter (comprised within the coefficient data 163) to create a nominal integer allocation vector used to control the spectral decoding, i.e. the decoding of the coefficient data 163. In particular, the nominal integer allocation vector may be used to determine a quantizer for inverse quantizing the quantization indices comprised within the coefficient data 163. The allocation envelope 138 and the nominal integer allocation vector may be determined in an analogue manner in the encoder 100, 170 and in the decoder 500.

FIG. 10 illustrates an example bit allocation process based on the allocation envelope 138. As outlined above, the allocation envelope 138 may be quantized according to a pre-determined resolution (e.g. a 3 dB resolution). Each quantized spectral energy value of the allocation envelope 138 may be assigned to a corresponding integer value, wherein adjacent integer values may represent a difference in spectral energy corresponding to the pre-determined resolution (e.g. 3 dB difference). The resulting set of integer numbers may be referred to as an integer allocation envelope 1004 (referred to as iEnv). The integer allocation envelope 1004 may be offset by the offset parameter to yield the nominal integer allocation vector (referred to as iAlloc) which provides a direct indication of the quantizer to be used to quantize the coefficient of a particular frequency band 302 (identified by a frequency band index, bandIdx).

FIG. 10 shows in diagram 1003 the integer allocation envelope 1004 as a function of the frequency bands 302. It can be seen that for frequency band 1002 (bandIdx=7) the integer allocation envelope 1004 takes on the integer value −17 (iEnv[7]=−17). The integer allocation envelope 1004 may be limited to a maximum value (referred to as iMax, e.g. iMax=−15). The bit allocation process may make use of a bit allocation formula which provides a quantizer index 1006 (referred to as iAlloc [bandIdx]) as a function of the integer allocation envelope 1004 and of the offset parameter (referred to as AllocOffset). As outlined above, the offset parameter (i.e. AllocOffset) is transmitted to the corresponding decoder 500, thereby enabling the decoder 500 to determine the quantizer indices 1006 using the bit allocation formula. The bit allocation formula may be given by $$i\text{Alloc}[\text{bandIdx}]=i\text{Env}[\text{bandIdx}]-(i\text{Max}-\text{CONSTANT_OFFSET})+\text{AllocOffset},$$

wherein CONSTANT_OFFSET may be a constant offset, e.g. CONSTANT_OFFSET=20. By way of example, if the bit allocation process has determined that the bit-rate constraint can be achieved using an offset parameter AllocOffset=−13, the quantizer index 1007 of the $7^{th}$ frequency band may be obtained as iAlloc[7]=−17−(−15-20)−13=5. By using the above mentioned bit allocation formula for all frequency bands 302, the quantizer indices 1006 (and by consequence the quantizers 321, 322, 323) for all frequency bands 302 may be determined. A quantizer index smaller than zero may be rounded up to a quantizer index zero. In a similar manner, a quantizer index greater than the maximum available quantizer index may be rounded down to the maximum available quantizer index.

Furthermore, FIG. 10 shows an example noise envelope 1011 which may be achieved using the quantization scheme described in the present document. The noise envelope 1011 shows the envelope of quantization noise that is introduced during quantization. If plotted together with the signal envelope (represented by the integer allocation envelope 1004 in FIG. 10), the noise envelope 1011 illustrates the fact the distribution of the quantization noise is perceptually optimized with respect to the signal envelope.

In order to allow a decoder 500 to synchronize with a received bitstream, different types of frames may be transmitted. A frame may correspond to a set 132, 332 of blocks, in particular to a shifted block 332 of blocks. In particular, so called P-frames may be transmitted, which are encoded in a relative manner with respect to a previous frame. In the above description, it was assumed that the decoder 500 is aware of the quantized previous envelope 135. The quantized previous envelope 135 may be provided within a previous frame, such that the current set 132 or the corresponding shifted set 332 may correspond to a P-frame. However, in a start-up scenario, the decoder 500 is typically not aware of the quantized previous envelope 135. For this purpose, an I-frame may be transmitted (e.g. upon start-up or on a regular basis). The I-frame may comprise two envelopes, one of which is used as the quantized previous envelope 135 and the other one is used as the quantized current envelope 134. I-frames may be used for the start-up case of the voice spectral frontend (i.e. of the transform-based speech decoder 500), e.g. when following a frame employing a different audio coding mode and/or as a tool to explicitly enable a splicing point of the audio bitstream.

Figure 5D:
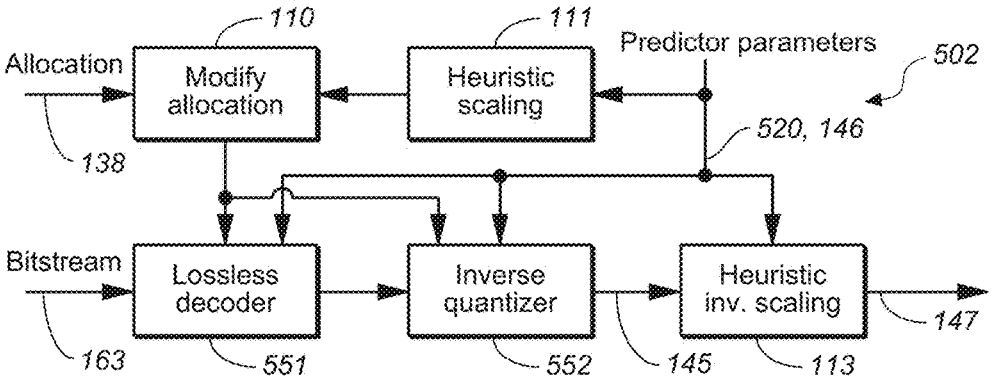

The operation of the subband predictor 517 is illustrated in FIG. 5*d*. In the illustrated example, the predictor parameters 520 are a lag parameter and a predictor gain parameter g. The predictor parameters 520 may be determined from the predictor data 164 using a pre-determined table of possible values for the lag parameter and the predictor gain parameter. This enables the bit-rate efficient transmission of the predictor parameters 520.

The one or more previously decoded transform coefficient vectors (i.e. the one or more previous blocks 149 of reconstructed coefficients) may be stored in a subband (or MDCT) signal buffer 541. The buffer 541 may be updated in accordance to the stride (e.g. every 5 ms). The predictor extractor 543 may be configured to operate on the buffer 541 depending on a normalized lag parameter T. The normalized lag parameter T may be determined by normalizing the lag parameter 520 to stride units (e.g. to MDCT stride units). If the lag parameter T is an integer, the extractor 543 may fetch one or more previously decoded transform coefficient vectors T time units into the buffer 541. In other words, the lag parameter T may be indicative of which ones of the one or more previous blocks 149 of reconstructed coefficients are to be used to determine the block 150 of estimated transform coefficients. A detailed discussion regarding a possible implementation of the extractor 543 is provided in the patent application U.S. Pat. No. 6,175,0052 and the patent applications which claim priority thereof, the content of which is incorporated by reference.

The extractor 543 may operate on vectors (or blocks) carrying full signal envelopes. On the other hand, the block 150 of estimated transform coefficients (to be provided by the subband predictor 517) is represented in the flattened domain. Consequently, the output of the extractor 543 may be shaped into a flattened domain vector. This may be achieved using a shaper 544 which makes use of the adjusted envelopes 139 of the one or more previous blocks 149 of reconstructed coefficients. The adjusted envelopes 139 of the one or more previous blocks 149 of reconstructed coefficients may be stored in an envelope buffer 542. The shaper unit 544 may be configured to fetch a delayed signal envelope to be used in the flattening from $T_0$ time units into the envelope buffer 542, where $T_0$ is the integer closest to T.

Then, the flattened domain vector may be scaled by the gain parameter g to yield the block 150 of estimated transform coefficients (in the flattened domain).

As an alternative, the delayed flattening process performed by the shaper 544 may be omitted by using a subband predictor 517 which operates in the flattened domain, e.g. a subband predictor 517 which operates on the blocks 148 of reconstructed flattened coefficients. However, it has been found that a sequence of flattened domain vectors (or blocks) does not map well to time signals due to the time aliased aspects of the transform (e.g. the MDCT transform). As a consequence, the fit to the underlying signal model of the extractor 543 is reduced and a higher level of coding noise results from the alternative structure. In other words, it has been found that the signal models (e.g. sinusoidal or periodic models) used by the subband predictor 517 yield an increased performance in the un-flattened domain (compared to the flattened domain).

It should be noted that in an alternative example, the output of the predictor 517 (i.e. the block 150 of estimated transform coefficients) may be added at the output of the inverse flattening unit 114 (i.e. to the block 149 of reconstructed coefficients) (see FIG. 5*a*). The shaper unit 544 of FIG. 5*c* may then be configured to perform the combined operation of delayed flattening and inverse flattening.

Elements in the received bitstream may control the occasional flushing of the subband buffer 541 and of the envelope buffer 541, for example in case of a first coding unit (i.e. a first block) of an I-frame. This enables the decoding of an I-frame without knowledge of the previous data. The first coding unit will typically not be able to make use of a predictive contribution, but may nonetheless use a relatively smaller number of bits to convey the predictor information 520. The loss of prediction gain may be compensated by allocating more bits to the prediction error coding of this first coding unit. Typically, the predictor contribution is again substantial for the second coding unit (i.e. a second block) of an I-frame. Due to these aspects, the quality can be maintained with a relatively small increase in bit-rate, even with a very frequent use of I-frames.

In other words, the sets 132, 332 of blocks (also referred to as frames) comprise a plurality of blocks 131 which may be encoded using predictive coding. When encoding an I-frame, only the first block 203 of a set 332 of blocks cannot be encoded using the coding gain achieved by a predictive encoder. Already the directly following block 201 may make use of the benefits of predictive encoding. This means that the drawbacks of an I-frame with regards to coding efficiency are limited to the encoding of the first block 203 of transform coefficients of the frame 332, and do not apply to the other blocks 201, 204, 205 of the frame 332. Hence, the transform-based speech coding scheme described in the present document allows for a relatively frequent use of I-frames without significant impact on the coding efficiency. As such, the presently described transform-based speech coding scheme is particularly suitable for applications which require a relatively fast and/or a relatively frequent synchronization between decoder and encoder.

FIG. 5*d* shows a block diagram of an example spectrum decoder 502. The spectrum decoder 502 comprises a lossless decoder 551 which is configured to decode the entropy encoded coefficient data 163. Furthermore, the spectrum decoder 502 comprises an inverse quantizer 552 which is configured to assign coefficient values to the quantization indices comprised within the coefficient data 163. As outlined in the context of the encoder 100, 170, different transform coefficients may be quantized using different quantizers selected from a set of pre-determined quantizers, e.g. a finite set of model based scalar quantizers. As shown in FIG. 4, a set of quantizers 321, 322, 323 may comprise different types of quantizers. The set of quantizers may comprise a quantizer 321 which provides noise synthesis (in case of zero bit-rate), one or more dithered quantizers 322 (for relatively low signal-to-noise ratios, SNRs, and for intermediate bit-rates) and/or one or more plain quantizers 323 (for relatively high SNRs and for relatively high bit-rates).

The envelope refinement unit 107 may be configured to provide the allocation envelope 138 which may be combined with the offset parameter comprised within the coefficient data 163 to yield an allocation vector. The allocation vector contains an integer value for each frequency band 302. The integer value for a particular frequency band 302 points to the rate-distortion point to be used for the inverse quantization of the transform coefficients of the particular band 302. In other words, the integer value for the particular frequency band 302 points to the quantizer to be used for the inverse quantization of the transform coefficients of the particular band 302. An increase of the integer value by one corresponds to a 1.5 dB increase in SNR. For the dithered quantizers 322 and the plain quantizers 323, a Laplacian probability distribution model may be used in the lossless coding, which may employ arithmetic coding. One or more dithered quantizers 322 may be used to bridge the gap in a seamless way between low and high bit-rate cases. Dithered quantizers 322 may be beneficial in creating sufficiently smooth output audio quality for stationary noise-like signals.

In other words, the inverse quantizer 552 may be configured to receive the coefficient quantization indices of a current block 131 of transform coefficients. The one or more coefficient quantization indices of a particular frequency band 302 have been determined using a corresponding quantizer from a pre-determined set of quantizers. The value of the allocation vector (which may be determined by offsetting the allocation envelope 138 with the offset parameter) for the particular frequency band 302 indicates the quantizer which has been used to determine the one or more coefficient quantization indices of the particular frequency band 302. Having identified the quantizer, the one or more coefficient quantization indices may be inverse quantized to yield the block 145 of quantized error coefficients.

Furthermore, the spectral decoder 502 may comprise an inverse-rescaling unit 113 to provide the block 147 of scaled quantized error coefficients. The additional tools and interconnections around the lossless decoder 551 and the inverse quantizer 552 of FIG. 5*d* may be used to adapt the spectral decoding to its usage in the overall decoder 500 shown in FIG. 5*a*, where the output of the spectral decoder 502 (i.e. the block 145 of quantized error coefficients) is used to provide an additive correction to a predicted flattened domain vector (i.e. to the block 150 of estimated transform coefficients). In particular, the additional tools may ensure that the processing performed by the decoder 500 corresponds to the processing performed by the encoder 100, 170.

In particular, the spectral decoder 502 may comprise a heuristic scaling unit 111. As shown in conjunction with the encoder 100, 170, the heuristic scaling unit 111 may have an impact on the bit allocation. In the encoder 100, 170, the current blocks 141 of prediction error coefficients may be scaled up to unit variance by a heuristic rule. As a consequence, the default allocation may lead to a too fine quantization of the final downscaled output of the heuristic scaling unit 111. Hence the allocation should be modified in a similar manner to the modification of the prediction error coefficients.

However, as outlined below, it may be beneficial to avoid the reduction of coding resources for one or more of the low frequency bins (or low frequency bands). In particular, this may be beneficial to counter a LF (low frequency) rumble/noise artifact which happens to be most prominent in voiced situations (i.e. for signal having a relatively large control parameter 146, rfu). As such, the bit allocation/quantizer selection in dependence of the control parameter 146, which is described below, may be considered to be a "voicing adaptive LF quality boost".

The spectral decoder may depend on a control parameter 146 named rfu which may be a limited version of the predictor gain g, e.g.

$$rfu=\min(1, \max(g, 0)).$$

Alternative methods for determining the control parameter 146, rfu, may be used. In particular, the control parameter 146 may be determined using the pseudo code given in Table 1.

TABLE 1

```
f_gain = f_pred_gain;
if (f_gain < −1.0)
    f_rfu = 1.0;
else if (f_gain < 0.0)
    f_rfu = −f_gain;
else if (f_gain < 1.0)
    f_rfu = f_gain;
else if (f_gain < 2.0)
    f_rfu = 2.0 − f_gain;
else // f_gain >= 2.0
    f_rfu = 0.0.
```

The variable f_gain and f_pred_gain may be set equal. In particular, the variable f_gain may correspond to the predictor gain g. The control parameter 146, rfu, is referred to as f_rfu in Table 1. The gain f_gain may be a real number.

Compared to the first definition of the control parameter 146, the latter definition (according to Table 1) reduces the control parameter 146, rfu, for predictor gains above 1 and increases the control parameter 146, rfu, for negative predictor gains.

Using the control parameter 146, the set of quantizers used in the coefficient quantization unit 112 of the encoder 100, 170 and used in the inverse quantizer 552 may be adapted. In particular, the noisiness of the set of quantizers may be adapted based on the control parameter 146. By way of example, a value of the control parameter 146, rfu, close to 1 may trigger a limitation of the range of allocation levels using dithered quantizers and may trigger a reduction of the variance of the noise synthesis level. In an example, a dither decision threshold at rfu=0.75 and a noise gain equal to 1−rfu may be set. The dither adaptation may affect both the lossless decoding and the inverse quantizer, whereas the noise gain adaptation typically only affects the inverse quantizer.

It may be assumed that the predictor contribution is substantial for voiced/tonal situations. As such, a relatively high predictor gain g (i.e. a relatively high control parameter 146) may be indicative of a voiced or tonal speech signal. In such situations, the addition of dither-related or explicit (zero allocation case) noise has shown empirically to be counterproductive to the perceived quality of the encoded signal. As a consequence, the number of dithered quantizers 322 and/or the type of noise used for the noise synthesis quantizer 321 may be adapted based on the predictor gain g, thereby improving the perceived quality of the encoded speech signal.

As such, the control parameter 146 may be used to modify the range 324, 325 of SNRs for which dithered quantizers 322 are used. By way of example, if the control parameter 146 rfu<0.75, the range 324 for dithered quantizers may be used. In other words, if the control parameter 146 is below a pre-determined threshold, the first set 326 of quantizers may be used. On the other hand, if the control parameter 146 rfu≥0.75, the range 325 for dithered quantizers may be used. In other words, if the control parameter 146 is greater than or equal to the pre-determined threshold, the second set 327 of quantizers may be used.

Furthermore, the control parameter 146 may be used for modification of the variance and bit allocation. The reason for this is that typically a successful prediction will require a smaller correction, especially in the lower frequency range from 0-1 kHz. It may be advantageous to make the quantizer explicitly aware of this deviation from the unit variance model in order to free up coding resources to higher frequency bands 302. This is described in the context of FIG. 17c panel iii of WO2009/086918, the content of which is incorporated by reference. In the decoder 500, this modification may be implemented by modifying the nominal allocation vector according to a heuristic scaling rule (applied by using the scaling unit 111), and at the same time scaling the output of the inverse quantizer 552 according to an inverse heuristic scaling rule using the inverse scaling unit 113. Following the theory of WO2009/086918, the heuristic scaling rule and the inverse heuristic scaling rule should be closely matched. However, it has been found empirically advantageous to cancel the allocation modification for the one or more lowest frequency bands 302, in order to counter occasional problems with LF (low frequency) noise for voiced signal components. The cancelling of the allocation modification may be performed in dependence on the value of the predictor gain g and/or of the control parameter 146. In particular, the cancelling of the allocation modification may be performed only if the control parameter 146 exceeds the dither decision threshold.

Hence, the present document describes means for adjusting the composition of the collection 326 of quantizers (e.g. the number of un-dithered quantizers 323 and/or the number of dithered quantizers 322) based on side information (e.g. the control parameter 146) which is available at the encoder 100, 170 and at the corresponding decoder 500. The composition of the collection 326 of quantizers may be adjusted in the presence of the predictor gain g (e.g. based on the control parameter 146). In particular, the number $N_{dith}$ of dithered quantizers 322 may be increased and the number $N_{cq}$ of un-dithered quantizers 323 may be decreased, if the predictor gain g is relatively low. Furthermore, the number of allocated bits may be reduced by selecting relatively coarser quantizers. On the other hand, the number $N_{dith}$ of dithered quantizers 322 may be decreased and the number $N_{cq}$ of dithered quantizers 323 may be increased, if the predictor gain g is relatively large. Furthermore, the number of allocated bits may be reduced by selecting relatively coarser quantizers.

Alternatively or in addition, the composition of the collection 326 of quantizers may be adjusted in the presence of a spectral reflection coefficient. In particular, the number $N_{dith}$ of dithered quantizers 322 may be increased in the case of hiss-like signals. Furthermore, the number of allocated bits may be reduced by selecting relatively coarser quantizers.

In the following, an example scheme for determining a spectral reflection coefficient Rfc indicative of a hiss-like property of the current excerpt of the input signal is described. It should be noted that the spectral reflection coefficient Rfc is different to the "reflection coefficient" used in the context of autoregressive source modeling. The block 131 of transform coefficients may be divided into L frequency bands 302. A L-dimensional vector $B_w$ may be defined, wherein the $l^{th}$ entry of the vector $B_w$ may be equal to the number of transform bins 301 that belong to the $l^{th}$ frequency band 302 (l=1, . . . , L). Similarly, a K-dimensional vector F may be defined, wherein the $l^{th}$ entry may be equal to the mid-point of the $l^{th}$ frequency band 302, which is obtained by computing the mean of the smallest index of a transform bin 301 and the largest index of a transform bin 301 that belong to the $l^{th}$ frequency band 302. Furthermore, a L-dimensional vector SPSD may be defined, wherein the vector $S_{PSD}$ may comprise values of the power spectral density of the signal, which may be obtained by converting the quantization indices related to the envelope from the dB scale back to the linear scale. In addition, a maximum bin index $N_{core}$ may be defined that is the largest bin index belonging to the $L^{th}$ frequency band 302. A scalar reflection coefficient Rfc may be determined as $$Rfc = \sum_{l=1}^{L} \frac{-B_w(l)S_{PSD}(l)\cos\left(\frac{\pi F(l)}{N_{core}}\right)}{\sum_{l=1}^{L} B_w(l)S_{PSD}(l)},$$

where l denotes a $l^{th}$ entry of a L-dimensional vector.

In general, Rfc>0 indicates a spectrum dominated by its high-frequency part, and Rfc<0 indicates a spectrum dominated by its low-frequency part. The Rfc parameter may be used as follows: If the Rfu value is low (i.e. if the prediction gain is low) and if the Rfc>0, then this indicates a spectrum corresponding to a fricative (i.e., voiceless sibilant). In this case, a relatively increased number $N_{dith}$ of dithered quantizers 322 may be used within the collection 326, 722 of quantizers.

In general terms, the collection 326 of quantizers (and the corresponding inverse quantizers) may be adjusted based on side information (e.g. the control parameter 146 and/or the spectral reflection coefficient) which is available at the encoder 100 and at the corresponding decoder 500. The side information may be extracted from the parameters available to the encoder 100 and to the decoder 500. As outlined above, the predictor gain g may be transmitted to the decoder 500 and can be used prior to the inverse quantization of the transform coefficients, to select the appropriate collection 326 of inverse quantizers. Alternatively or in addition, a reflection coefficient may be estimated or approximated based on the spectral envelope that is transmitted to the decoder 500.

Figure 7:
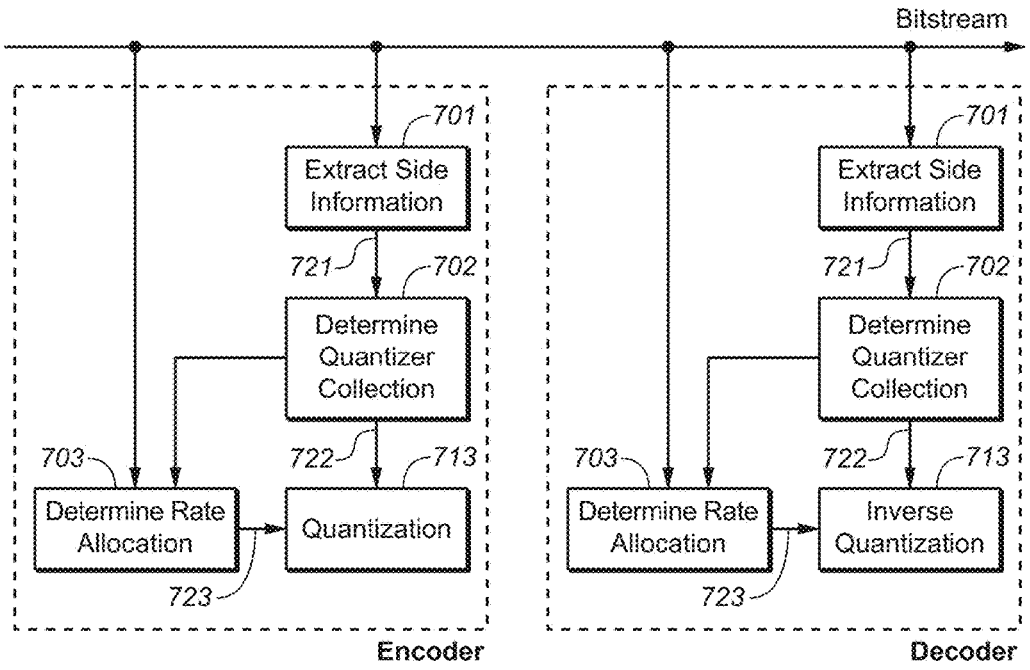
FIG. 7 illustrates an example scheme for determining a set of quantizers at an encoder and at a corresponding decoder.

FIG. 7 shows a block diagram of an example method for determining a collection 326 of quantizers/inverse quantizers at the encoder 100 and at the corresponding decoder 500. Relevant side information 721 (such as the predictor parameter g and/or the reflection coefficient) may be extracted 701 from the bitstream. The side information 721 may be used to determine 702 a collection 722 of quantizers to be used for quantizing the current block coefficients and/or for inverse quantizing the corresponding quantization indices. Using the rate allocation process 703 a particular quantizer from the determined collection 722 of quantizers is used to quantize the coefficients of a particular frequency band 302 and/or to inverse quantize the corresponding quantization indices. The quantizer selection 723 resulting from the bit allocation process 703 is used within the quantization process 703 to yield the quantization indices and/or is used within the inverse quantization process 713 to yield the quantized coefficients.

FIGS. 9*a* to 9*c* show example experimental results which may be achieved using the transform-based codec system described in the present document. In particular, FIGS. 9*a* to 9*c* illustrate the benefits of using an ordered collection 326 of quantizers comprising one or more dithered quantizers 322. FIG. 9*a* shows the spectrogram 901 of an original signal. It can be seen that the spectrogram 901 comprises spectral content in the frequency range identified by the white circle. FIG. 9*b* shows the spectrogram 902 of a quantized version of the original signal (quantized at 22 kps). In the case of FIG. 9*b* noise—fill for the zero rate allocation and scalar quantizers were used. It can be seen that the spectrogram 902 exhibits relatively large spectral blocks in the frequency range identified by the white circle that are associated with shallow spectral holes (so-called "birdies"). These blocks typically lead to audible artifacts. FIG. 9*c* shows the spectrogram 903 of another quantized version of the original signal (quantized at 22 kps). In the case of FIG. 9*c* noise—fill for the zero rate allocation, dithered quantizers and scalar quantizers were used (as described in the present document). It can be seen that the spectrogram 903 does not exhibit large spectral blocks associated with spectral holes in the frequency range identified by the white circle. It is known to people familiar with the art that, the absence of such quantization blocks is an indication of the improved perceptual performance of the transform-based codec system described in the present document.

In the following, various additional aspects of an encoder 100, 170 and/or a decoder 500 are described. As outlined above, an encoder 100, 170 and/or a decoder 500 may comprise a scaling unit 111 which is configured to rescale the prediction error coefficients Δ(k) to yield a block 142 of rescaled error coefficients. The rescaling unit 111 may make use of one or more pre-determined heuristic rules to perform the rescaling. In an example, the rescaling unit 111 may make use of a heuristic scaling rule which comprises the gain d(f), e.g.

$$d(f) = 1 + \frac{7 \cdot rfu^2}{1 + \left(\frac{f}{f_0}\right)^3}$$

where a break frequency $f_0$ may be set to e.g. 1000 Hz. Hence, the rescaling unit 111 may be configured to apply a frequency dependent gain d(f) to the prediction error coefficients to yield the block 142 of rescaled error coefficients. The inverse rescaling unit 113 may be configured to apply an inverse of the frequency dependent gain d(f). The frequency dependent gain d(f) may be dependent on the control parameter rfu 146. In the above example, the gain d(f) exhibits a low pass character, such that the prediction error coefficients are attenuated more at higher frequencies than at lower frequencies and/or such that the prediction error coefficients are emphasized more at lower frequencies than at higher frequencies. The above mentioned gain d(f) is always greater or equal to one. Hence, in a preferred embodiment, the heuristic scaling rule is such that the prediction error coefficients are emphasized by a factor one or more (depending on the frequency).

It should be noted that the frequency-dependent gain may be indicative of a power or a variance. In such cases, the scaling rule and the inverse scaling rule should be derived based on a square root of the frequency-dependent gain, e.g. based on $\sqrt{d(f)}$.

The degree of emphasis and/or attenuated may depend on the quality of the prediction achieved by the predictor 117. The predictor gain g and/or the control parameter rfu 146 may be indicative of the quality of the prediction. In particular, a relatively low value of the control parameter rfu 146 (relatively close to zero) may be indicative of a low quality of prediction. In such cases, it is to be expected that the prediction error coefficients have relatively high (absolute) values across all frequencies. A relatively high value of the control parameter rfu 146 (relatively close to one) may be indicative of a high quality of prediction. In such cases, it is to be expected that the prediction error coefficients have relatively high (absolute) values for high frequencies (which are more difficult to predict). Hence, in order to achieve unit variance at the output of the rescaling unit 111, the gain d(f) may be such that in case of a relatively low quality of prediction, the gain d(f) is substantially flat for all frequencies, whereas in case of a relatively high quality of prediction, the gain d(f) has a low pass character, to increase or boost the variance at low frequencies. This is the case for the above mentioned rfu-dependent gain d(f).

As outlined above, the bit allocation unit 110 may be configured to provide a relative allocation of bits to the different rescaled error coefficients, depending on the corresponding energy value in the allocation envelope 138. The bit allocation unit 110 may be configured to take into account the heuristic rescaling rule. The heuristic rescaling rule may be dependent on the quality of the prediction. In case of a relatively high quality of prediction, it may be beneficial to assign a relatively increased number of bits to the encoding of the prediction error coefficients (or the block 142 of rescaled error coefficients) at high frequencies than to the encoding of the coefficients at low frequencies. This may be due to the fact that in case of a high quality of prediction, the low frequency coefficients are already well predicted, whereas the high frequency coefficients are typically less well predicted. On the other hand, in case of a relatively low quality of prediction, the bit allocation should remain unchanged.

The above behavior may be implemented by applying an inverse of the heuristic rules/gain d(f) to the current adjusted envelope 139, in order to determine an allocation envelope 138 which takes into account the quality of prediction.

The adjusted envelope 139, the prediction error coefficients and the gain d(f) may be represented in the log or dB domain. In such case, the application of the gain d(f) to the prediction error coefficients may correspond to an "add" operation and the application of the inverse of the gain d(f) to the adjusted envelope 139 may correspond to a "subtract" operation.

It should be noted that various variants of the heuristic rules/gain d(f) are possible. In particular, the fixed frequency dependent curve of low pass character $$\left(1+\left(\frac{f}{f_0}\right)^3\right)^{-1}$$

may be replaced by a function which depends on the envelope data (e.g. on the adjusted envelope 139 for the current block 131). The modified heuristic rules may depend both on the control parameter rfu 146 and on the envelope data.

In the following different ways for determining a predictor gain ρ, which may correspond to the predictor gain g, are described. The predictor gain ρ may be used as an indication of the quality of the prediction. The prediction residual vector (i.e. the block 141 of prediction error coefficients z may be given by: $z=x-\rho y$, where x is the target vector (e.g. the current block 140 of flattened transform coefficients or the current block 131 of transform coefficients), y is a vector representing the chosen candidate for prediction (e.g. a previous blocks 149 of reconstructed coefficients), and ρ is the (scalar) predictor gain.

$w \geq 0$ may be a weight vector used for the determination of the predictor gain ρ. In some embodiments, the weight vector is a function of the signal envelope (e.g. a function of the adjusted envelope 139, which may be estimated at the encoder 100, 170 and then transmitted to the decoder 500). The weight vector typically has the same dimension as the target vector and the candidate vector. An i-th entry of the vector x may be denoted by $x_i$ (e.g. i=1, . . . , K).

There are different ways for defining the predictor gain ρ. In an embodiment, the predictor gain ρ is an MMSE (minimum mean square error) gain defined according to the minimum mean squared error criterion. In this case, the predictor gain ρ may be computed using the following formula:

$$\rho = \frac{\sum_i x_i y_i}{\sum_i y_i^2}.$$

Such a predictor gain ρ typically minimizes the mean squared error defined as $$D = \sum_i (x_i - \rho y_i)^2$$

It is often (perceptually) beneficial to introduce weighting to the definition of the means squared error D . The weighting may be used to emphasize the importance of a match between x and y for perceptually important portions of the signal spectrum and deemphasize the importance of a match between x and y for portions of the signal spectrum that are relatively less important. Such an approach results in the following error criterion:

$$D = \sum_i (x_i - \rho y_i)^2 w_i,$$

which leads to the following definition of the optimal predictor gain (in the sense of the weighted mean squared error):

$$\rho = \frac{\sum_i w_i x_i y_i}{\sum_i w_i y_i^2}.$$

The above definition of the predictor gain typically results in a gain that is unbounded. As indicated above, the weights $w_i$ of the weight vector w may be determined based on the adjusted envelope 139. For example, the weight vector w may be determined using a predefined function of the adjusted envelope 139. The predefined function may be known at the encoder and at the decoder (which is also the case for the adjusted envelope 139). Hence, the weight vector may be determined in the same manner at the encoder and at the decoder.

Another possible predictor gain formula is given by $$\rho = \frac{2C}{E_x + E_y},$$

where $$C = \sum_i w_i x_i y_i,\ E_x = \sum_i w_i x_i^2 \text{ and } E_y = \sum_i w_i y_i^2.$$

This definition of the predictor gain yields a gain that is always within the interval [−1, 1]. An important feature of the predictor gain specified by the latter formula is that the predictor gain ρ facilitates a tractable relationship between the energy of the target signal x and the energy of the residual signal z. The LTP residual energy may be expressed as:

$$\sum_i w_i z_i^2 = E_x(1 - \rho^2).$$

The control parameter rfu 146 may be determined based on the predictor gain g using the above mentioned formulas. The predictor gain g may be equal to the predictor gain ρ, determined using any of the above mentioned formulas.

As outlined above, the encoder 100, 170 is configured to quantize and encoder the residual vector z (i.e. the block 141 of prediction error coefficients). The quantization process is typically guided by the signal envelope (e.g. by the allocation envelope 138) according to an underlying perceptual model in order to distribute the available bits among the spectral components of the signal in a perceptually meaningful way. The process of rate allocation is guided by the signal envelope (e.g. by the allocation envelope 138), which is derived from the input signal (e.g. from the block 131 of transform coefficients). The operation of the predictor 117 typically changes the signal envelope. The quantization unit 112 typically makes use of quantizers which are designed assuming operation on a unit variance source. Notably in case of high quality prediction (i.e. when the predictor 117 is successful), the unit variance property may no longer be the case, i.e. the block 141 of prediction error coefficients may not exhibit unit variance.

It is typically not efficient to estimate the envelope of the block 141 of prediction error coefficients (i.e. for the residual z) and to transmit this envelope to the decoder (and to re-flatten the block 141 of prediction error coefficients using the estimated envelope). Instead, the encoder 100 and the decoder 500 may make use of a heuristic rule for rescaling the block 141 of prediction error coefficients (as outlined above). The heuristic rule may be used to rescale the block 141 of prediction error coefficients, such that the block 142 of rescaled coefficients approaches the unit variance. As a result of this, quantization results may be improved (using quantizers which assume unit variance).

Furthermore, as has already been outlined, the heuristic rule may be used to modify the allocation envelope 138, which is used for the bit allocation process. The modification of the allocation envelope 138 and the rescaling of the block 141 of prediction error coefficients are typically performed by the encoder 100 and by the decoder 500 in the same manner (using the same heuristic rule).

A possible heuristic rule d(f) has been described above. In the following another approach for determining a heuristic rule is described. An inverse of the weighted domain energy prediction gain may be given by $p \in [0,1]$ such that $\|z\|_w^2 = p\|x\|_w^2$, wherein $\|z\|_w^2$ indicates the squared energy of the residual vector (i.e. the block 141 of prediction error coefficients) in the weighted domain and wherein $\|x\|_w^2$ indicates the squared energy of the target vector (i.e. the block 140 of flattened transform coefficients) in the weighted domain The following assumptions may be made 1. The entries of the target vector x have unit variance. This may be a result of the flattening performed by the flattening unit 108. This assumption is fulfilled depending on the quality of the envelope based flattening performed by the flattening unit 108.
2. The variance of the entries of the prediction residual vector z are of the form of $$E\{z^2(i)\} = \min\left\{\frac{t}{w(i)}, 1\right\}$$

for i=1, . . . , K and for some t≥0. This assumption is based on the heuristic that a least squares oriented predictor search leads to an evenly distributed error contribution in the weighted domain, such that the residual vector $\sqrt{w}z$ is more or less flat. Furthermore, it may be expected that the predictor candidate is close to flat which leads to the reasonable bound $E\{z^2(i)\} \le 1$. It should be noted that various modifications of this second assumption may be used.

In order to estimate the parameter t, one may insert the above mentioned two assumptions into the prediction error formula $$\left(\text{e.g. } D = \sum_i (x_i - \rho y_i)^2 w_i\right)$$

and thereby provide the "water level type" equation $$\sum_i \min\{t, w(i)\} = p \sum_i w(i)$$

It can be shown that there is a solution to the above equation in the interval $t \in [0, \max(w(i))]$. The equation for finding the parameter t may be solved using sorting routines.

The heuristic rule may then be given by $$d(i) = \max\left\{\frac{w(i)}{t}, 1\right\},$$

wherein i=1, . . . , K identifies the frequency bin. The inverse of the heuristic scaling rule is given by $$\frac{1}{d(i)} = \min\left\{\frac{t}{w(i)}, 1\right\}.$$

The inverse of the heuristic scaling rule is applied by the inverse rescaling unit 113. The frequency-dependent scaling rule depends on the weights $w(i)=w_i$. As indicated above, the weights w(i) may be dependent on or may correspond to the current block 131 of transform coefficients (e.g. the adjusted envelope 139, or some predefined function of the adjusted envelope 139).

It can be shown that when using the formula $$\rho = \frac{2C}{E_x + E_y}$$

to determine the predictor gain, the following relation applies: $p=1-\rho^2$.

Hence, a heuristic scaling rule may be determined in various different ways. It has been shown experimentally that the scaling rule which is determined based on the above mentioned two assumptions (referred to as scaling method B) is advantageous compared to the fixed scaling rule d(f). In particular, the scaling rule which is determined based on the two assumptions may take into account the effect of weighting used in the course of a predictor candidate search. The scaling method B is conveniently combined with the definition of the gain $$\rho = \frac{2C}{E_x + E_y},$$

because of the analytically tractable relationship between the variance of the residual and the variance of the signal (which facilitates derivation of p as outlined above).

In the following, a further aspect for improving the performance of the transform-based audio coder is described. In particular, the use of a so called variance preservation flag is proposed. The variance preservation flag may be determined and transmitted on a per block 131 basis. The variance preservation flag may be indicative of the quality of the prediction. In an embodiment, the variance preservation flag is off, in case of a relatively high quality of prediction, and the variance preservation flag is on, in case of a relatively low quality of prediction. The variance preservation flag may be determined by the encoder 100, 170, e.g. based on the predictor gain ρ and/or based on the predictor gain g. By way of example, the variance preservation flag may be set to "on" if the predictor gain ρ or g (or a parameter derived therefrom) is below a pre-determined threshold (e.g. 2 dB) and vice versa. As outlined above, the inverse of the weighted domain energy prediction gain p typically depends on the predictor gain, e.g. $p=1-\rho^2$. The inverse of the parameter p may be used to determine a value of the variance preservation flag. By way of example, 1/p (e.g. expressed in dB) may be compared to a pre-determined threshold (e.g. 2 dB), in order to determine the value of the variance preservation flag. If 1/p is greater than the pre-determined threshold, the variance preservation flag may be set "off" (indicating a relatively high quality of prediction), and vice versa.

The variance preservation flag may be used to control various different settings of the encoder 100 and of the decoder 500. In particular, the variance preservation flag may be used to control the degree of noisiness of the plurality of quantizers 321, 322, 323. In particular, the variance preservation flag may affect one or more of the following settings

- Adaptive noise gain for zero bit allocation. In other words, the noise gain of the noise synthesis quantizer 321 may be affected by the variance preservation flag.
- Range of dithered quantizers. In other words, the range 324, 325 of SNRs for which dithered quantizers 322 are used may be affected by the variance preservation flag.
- Post-gain of the dithered quantizers. A post-gain may be applied to the output of the dithered quantizers, in order to affect the mean square error performance of the dithered quantizers. The post-gain may be dependent on the variance preservation flag.
- Application of heuristic scaling. The use of heuristic scaling (in the rescaling unit 111 and in the inverse rescaling unit 113) may be dependent on the variance preservation flag.

An example of how the variance preservation flag may change one or more settings of the encoder 100 and/or the decoder 500 is provided in Table 2.

TABLE 2

| Setting type | Variance preservation off | Variance preservation on |
|---|---|---|
| Noise gain | $g_N = (1 - rfu)$ | $g_N = \sqrt{(1-rfu^2)}$ |
| Range of dithered quantizers | Depends on the control parameter rfu | Is fixed to a relatively large range (e.g. to the largest possible range) |
| Post-gain of the dithered quantizers. | $\gamma = \gamma_0$. $\gamma_o = \frac{\sigma_X^2}{\sigma_X^2 + \frac{\Delta^2}{12}}$; $\gamma_1 = \sqrt{\gamma_o}$ | $\gamma = \max(\gamma_o, g_N \cdot \gamma_1)$ |
| Heuristic scaling rule | on | off |

In the formula for the post-gain, $\sigma_x^2=E\{X^2\}$ is a variance of one or more of the coefficients of the block 141 of prediction error coefficients (which are to be quantized), and Δ is a quantizer step size of a scalar quantizer (612) of the dithered quantizer to which the post-gain is applied.

As can be seen from the example of Table 2, the noise gain $g_N$ of the noise synthesis quantizer 321 (i.e. the variance of the noise synthesis quantizer 321) may depend on the variance preservation flag. As outlined above, the control parameter rfu 146 may be in the range [0, 1], wherein a relatively low value of rfu indicates a relatively low quality of prediction and a relatively high value of rfu indicates a relatively high quality of prediction. For rfu values in the range of [0, 1], the left column formula provides lower noise gains $g_N$ than the right column formula. Hence, when the variance preservation flag is on (indicating a relatively low quality of prediction), a higher noise gain is used than when the variance preservation flag is off (indicating a relatively high quality of prediction). It has been shown experimentally that this improves the overall perceptual quality.

As outlined above, the SNR range of the 324, 325 of the dithered quantizers 322 may vary depending on the control parameter rfu. According to Table 2, when the variance preservation flag is on (indicating a relatively low quality of prediction), a fixed large range of dithered quantizers 322 is used (e.g. the range 324). On the other hand, when the variance preservation flag is off (indicating a relatively high quality of prediction), different ranges 324, 325 are used, depending on the control parameter rfu.

As has been outlined above, the determination of the block 145 of quantized error coefficients may involve the application of a post-gain γ to the quantized error coefficients, which have been quantized using a dithered quantizer 322. The post-gain γ may be derived to improve the MSE performance of a dithered quantizer 322 (e.g. a quantizer with a subtractive dither).

It has been shown experimentally that the perceptual coding quality can be improved, when making the post-gain dependent on the variance preservation flag. The above mentioned MSE optimal post-gain is used, when the variance preservation flag is off (indicating a relatively high quality of prediction). On the other hand, when the variance preservation flag is on (indicating a relatively low quality of prediction), it may be beneficial to use a higher post-gain (determined in accordance to the formula of the right hand side of Table 2).

As outlined above, heuristic scaling may be used to provide blocks 142 of rescaled error coefficients which are closer to the unit variance property than the blocks 141 of prediction error coefficients. The heuristic scaling rules may be made dependent on the control parameter 146. In other words, the heuristic scaling rules may be made dependent on the quality of prediction. Heuristic scaling may be particularly beneficial in case of a relatively high quality of prediction, whereas the benefits may be limited in case of a relatively low quality of prediction. In view of this, it may be beneficial to only make use of heuristic scaling when the variance preservation flag is off (indicating a relatively high quality of prediction).

In the present document, a transform-based speech encoder 100, 170 and a corresponding transform-based speech decoder 500 have been described. The transform-based speech codec may make use of various aspects which allow improving the quality of encoded speech signals. In particular, the speech codec may be configured to create an ordered collection of quantizers comprising classic (undithered) quantizers, quantizers with subtractive dithering, and "zero-rate" noise-fill. The ordered collection of quantizers may be created in a way that the ordered collection facilitates the rate allocation process according to a perceptual model parameterized by the signal envelope and by the rate allocation parameter. The composition of the collection of quantizers may be reconfigured in the presence of side information (e.g., the predictor gain) to improve the perceptual performance of the quantization scheme. A rate allocation algorithm may be used, which facilitates the usage of the ordered collection of quantizers without the need for additional signaling to the decoder, e.g. additional signaling related to a particular composition of the collection of quantizers which was used at the encoder and/or related to the dither signal which was used to implement the dithered quantizers. Furthermore, a rate allocation algorithm may be used, which facilitates the usage of an arithmetic coder (or a range coder) in the presence of a bit-rate constraint (e.g., a constraint on the maximum allowed number of bits and/or a constraint on the maximum admissible message length). In addition, the ordered collection of quantizers facilitates the usage of dithered quantizers, while allowing for the allocation of zero-bits to particular frequency bands. Furthermore, a rate allocation algorithm may be used, which facilitates the use of the ordered collection of quantizers in conjunction with Huffman coding.

The methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the Internet. Typical devices making use of the methods and systems described in the present document are portable electronic devices or other consumer equipment which are used to store and/or render audio signals.

What is claimed is:

1. A transform-based audio encoder configured to encode an audio signal into a bitstream; the encoder comprising hardware implementing a quantization unit configured to determine a plurality of quantization indices by quantizing a plurality of coefficients from a block of coefficients using a dithered quantizer; wherein the plurality of coefficients is associated with a plurality of corresponding frequency bins; wherein the block of coefficients is derived from the audio signal;

a dither generator configured to select one of M pre-determined dither realizations, and configured to generate a plurality of pseudo-random dither values for quantizing the plurality of coefficients, respectively, based on the selected dither realization; wherein M is an integer greater than one; and an entropy encoder configured to select a codebook from M pre-determined codebooks, and configured to entropy encode the plurality of quantization indices using the selected codebook; wherein the M pre-determined codebooks are associated with the M pre-determined dither realizations, respectively; wherein the M pre-determined codebooks have been trained using the M pre-determined dither realizations, respectively; wherein the entropy encoder is configured to select the codebook associated with the dither realization selected by the dither generator; and wherein the transform-based audio encoder is configured to insert coefficient data indicative of the entropy encoded quantization indices into the bitstream.

2. The transform-based speech encoder of claim 1, wherein the number M of pre-determined dither realizations is 10, 5, 4 or less.

3. The transform-based speech encoder of any of claims 1, wherein the M pre-determined codebooks comprise variable-length Huffman codewords.

4. A transform-based audio decoder configured to decode a bitstream to provide a reconstructed audio signal; the decoder comprising hardware implementing a dither generator configured to select one of M pre-determined dither realizations, and configured to generate a plurality of dither values based on the selected dither realization; wherein M is an integer greater than one; wherein the plurality of dither values is used by an inverse quantization unit comprising a dithered quantizer configured to determine a corresponding plurality of quantized coefficients based on a corresponding plurality of quantization indices; and an entropy decoder configured to select a codebook from M pre-determined codebooks and configured to entropy decode coefficient data from the bitstream using the selected codebook, to provide the plurality of quantization indices; wherein the M pre-determined codebooks are associated with the M pre-determined dither realizations, respectively; wherein the M pre-determined codebooks have been trained using the M pre-determined dither realizations, respectively; and wherein the entropy decoder is configured to select the codebook associated with the dither realization selected by the dither generator; wherein the entropy decoder is configured to determine the reconstructed audio signal based on the plurality of quantized coefficients.

5. A method for encoding an audio signal into a bitstream; the method comprising determining a plurality of quantization indices by quantizing a plurality of coefficients from a block of coefficients using a dithered quantizer; wherein the plurality of coefficients is associated with a plurality of corresponding frequency bins; wherein the block of coefficients is derived from the audio signal;

selecting one of M pre-determined dither realizations;

generating a plurality of dither values for quantizing the plurality of coefficients, based on the selected dither realization; wherein M is an integer greater one;

selecting a codebook from M pre-determined codebooks;

entropy encoding the plurality of quantization indices using the selected codebook; wherein the M pre-determined codebooks are associated with the M pre-determined dither realizations, respectively; wherein the M pre-determined codebooks have been trained using the M pre-determined dither realizations, respectively; wherein the selected codebook is associated with the selected dither realization; and inserting coefficient data indicative of the entropy encoded quantization indices into the bitstream.

6. A method for decoding a bitstream to provide a reconstructed audio signal; the method comprising selecting one of M pre-determined dither realizations;

generating a plurality of dither values based on the selected dither realization; wherein M is an integer greater one; wherein the plurality of dither values is used by an inverse quantization unit comprising a dithered quantizer to determine a corresponding plurality of quantized coefficients based on a corresponding plurality of quantization indices;

selecting a codebook from M pre-determined codebooks;

entropy decoding coefficient data from the bitstream using the selected codebook, to provide the plurality of quantization indices; wherein the M pre-determined codebooks are associated with the M pre-determined dither realizations, respectively; wherein the M pre-determined codebooks have been trained using the M pre-determined dither realizations, respectively; and wherein the selected codebook is associated with the selected dither realization; and determining the reconstructed audio signal based on the plurality of quantized coefficients.

7. A method for encoding a speech signal into a bitstream; the method comprising:

receiving a plurality of sequential blocks of transform coefficients comprising a current block and one or more previous blocks; wherein the plurality of sequential blocks is indicative of samples of the speech signal;

determining a current block of flattened transform coefficients by flattening the corresponding current block of transform coefficients using a corresponding current block envelope;

determining a current block of estimated flattened transform coefficients based on one or more previous blocks of reconstructed transform coefficients and based on one or more predictor parameters; wherein the one or more previous blocks of reconstructed transform coefficients have been derived from the one or more previous blocks of transform coefficients;

determining a current block of prediction error coefficients based on the current block of flattened transform coefficients and based on the current block of estimated flattened transform coefficients; and determining coefficient data for the bitstream based on quantization indices associated with the current block of prediction error coefficients;

encoding the speech signal into the bitstream based on the coefficient data.

8. A method for decoding a bitstream to provide a reconstructed speech signal; the method comprising determining a current block of estimated flattened transform coefficients based on one or more previous blocks of reconstructed transform coefficients and based on one or more predictor parameters derived from the bitstream;

determining a current block of quantized prediction error coefficients based on coefficient data comprised within the bitstream;

determining a current block of reconstructed flattened transform coefficients based on the current block of estimated flattened transform coefficients and based on the current block of quantized prediction error coefficients;

determining a current block of reconstructed transform coefficients by providing the current block of reconstructed flattened transform coefficients with a spectral shape, using a current block envelope; and determining the reconstructed speech signal based on the current block of reconstructed transform coefficients.

* * * * *